US005176164A

United States Patent [19]

Boyle

[11] Patent Number: 5,176,164

[45] Date of Patent: Jan. 5, 1993

[54] FLOW CONTROL VALVE SYSTEM

[75] Inventor: William G. Boyle, Dallas, Tex.

[73] Assignee: Otis Engineering Corporation, Dallas, Tex.

[21] Appl. No.: 457,520

[22] Filed: Dec. 27, 1989

[51] Int. Cl.[5] ..... F04F 1/08; F16K 31/04

[52] U.S. Cl. ..... 137/155; 137/487.5; 251/129.04; 251/129.19; 251/129.2

[58] Field of Search ..... 137/487.5, 155; 251/129.04, 129.19, 129.2, 129.12, 129.13; 166/66.4, 332, 373

[56] References Cited

U.S. PATENT DOCUMENTS

| | | | |
|---|---|---|---|
| 2,278,532 | 4/1942 | Crickmer | 137/155 X |
| 2,703,532 | 3/1955 | Bobo | 137/155 X |
| 2,725,014 | 11/1955 | Pryor | 137/155 X |
| 2,759,429 | 8/1956 | Bubb | 137/155 X |
| 2,869,475 | 1/1959 | Bobo | 137/155 X |
| 3,362,347 | 1/1968 | Canalizo | 137/155 X |
| 3,427,989 | 2/1969 | Bostock et al. | 137/155 X |
| 3,704,853 | 12/1972 | Waller | 251/129.13 X |
| 3,776,249 | 12/1973 | Wailes et al. | 137/487.5 X |
| 4,215,746 | 8/1980 | Hallden et al. | 166/66.4 X |
| 4,295,795 | 10/1981 | Gass et al. | 137/155 X |
| 4,622,503 | 11/1986 | Sundblom et al. | 251/129.13 X |
| 4,702,273 | 10/1987 | Allen, Jr. et al. | 137/487.5 |
| 4,763,681 | 8/1988 | Cuny et al. | 137/487.5 X |
| 4,768,548 | 9/1988 | Maurer | 137/487.5 |
| 4,791,954 | 12/1988 | Hasegawa | 137/487.5 |
| 4,798,227 | 1/1989 | Goodwin | 251/129.11 X |
| 4,798,247 | 1/1989 | Deaton et al. | 251/129.2 X |
| 4,840,350 | 6/1989 | Cook | 251/129.12 X |

FOREIGN PATENT DOCUMENTS

| | | |
|---|---|---|
| 625667 | 7/1949 | United Kingdom . |
| 1216890 | 12/1970 | United Kingdom . |
| 1340570 | 12/1973 | United Kingdom . |
| 1363922 | 8/1974 | United Kingdom . |
| 2092271A | 8/1982 | United Kingdom . |
| 2121926A | 1/1984 | United Kingdom . |
| WO84/00592 | 2/1984 | United Kingdom . |
| 2216570A | 11/1989 | United Kingdom . |

*Primary Examiner*—John Rivell
*Attorney, Agent, or Firm*—Johnson & Gibbs

[57] ABSTRACT

A flow control valve system for production of wells such as by gas lift including a downhole valve electrically or pressure pulse controlled from the surface including a valve having apparatus for controlling the flow rate through the valve by varying the valve orifice size over a continuous range and maintaining the orifice size constant when desired. Both rotary and poppet type valves are disclosed. Valve orifice size and well conditions are monitored downhole and transmitted to the surface for control of the valve.

11 Claims, 10 Drawing Sheets

FLOW CONTROL VALVE SYSTEM

BACKGROUND OF THE INVENTION

1. Field of the Invention

The invention relates to well production control systems, and more particularly, to an electrically actuated downhole valve system.

2. History of the Prior Art

In the operation of petroleum production wells, it is necessary to provide valves located within the production equipment down in a borehole for the control of various functions in the well. For example, in the operation of a gas lift well, it is necessary to selectively introduce the flow of high pressure gas to the tubing of a well in order to clear the accumulated borehole fluids from within the well and allow the flow of fluids from the production zone of the producing formation into the well tubing and to the surface for collection. Periodically, a mixture of oil and water collects in the bottom of the well casing and tubing in the region of the producing formation and obstructs the flow of gases to the surface. In a "gas lift" well completion high pressure gas from an external source is injected into the well in order to lift the borehole fluids collected in the well tubing to the surface to "clear" the well and allow the free flow of production fluids to the surface. This injection of gas into the well requires the operation of a valve controlling that injection gas flow known as a gas lift valve. Gas lift valves are conventionally normally closed restricting the flow of injection gas from the casing into the tubing and are opened to allow the flow of inject gas in response to either a preselected pressure condition or control from the surface. Generally such surface controlled valves are hydraulically operated. By controlling the flow of a hydraulic fluid from the surface, a poppet valve is actuated to control the flow of fluid into the gas lift valve. The valve is moved from a closed to an open position for as long as necessary to effect the flow of the lift gas. Such valves are also position instable, that is upon interruption of the hydraulic control pressure, the gas lift valve returns to its normally closed configuration.

A difficulty inherent in the use of gas lift valves which are either full open or closed is that gas lift production completions are a closed fluid system which are highly elastic in nature due to the compressibility of the fluids and the frequently large depth of the wells. For this reason, and especially in the case of dual completion wells, the flow of injected gas through a full open gas lift valve may produce vibrations at a harmonic frequency of the closed system and thereby create resonant oscillations in the system generating extremely large and destructive forces within the production equipment. Gas lift valves of a particular size aperture positioned at a point of resonance within the well completion(s) may have to be replaced in order for the system to be operable.

While electrically controlled gas lift valves are also available, for example as shown in U.S. Pat. No. 3,427,989, assigned to the assignee of the present invention, they include the disadvantages of other gas lift valve which are position instable and which operate based upon either full open or full closed conditions.

Another application of downhole fluid control valves within a production well is that of chemical injection. In some wells, it becomes necessary to inject a flow of chemicals into the borehole in order to treat either the well production equipment or the formation surrounding the borehole. The introduction of chemicals through a downhole valve capable of only full open or full closed condition does not allow precise control over the quantity of chemicals injected into the well.

Another application of downhole flow control valves is that of a dual completion gas lift operation in a well. By varying the orifice size of the gas injection valve the differential pressure drop across the gas lift valve can be controlled so that the pressure of the gas inside each string of tubing at the injection valve can be matched with the needs of that particular formation. However, flow control valves capable of only full open or closed configurations contribute to imprecise control over the pressure drop. In addition, such systems also suffer from potential resonance due to oscillations generated by flow through the valve which may necessitate tuning the system in some fashion or replacement of the valve in order for the system to be operable.

As mentioned above, prior art flow control valves for downhole applications, such as gas lift valves, include a number of inherent disadvantages. A first of these is having a single size flow orifice in the open condition which may produce resonant oscillations resulting in destructive effects within the well. A second disadvantage is that of being capable of assuming only a full open or full closed position which requires the shuttling of the valve between these two positions at high pressures and results in tremendous wear and tear on the valves. Such wear requires frequent maintenance and/or replacement of the valves which is extremely expensive. Hydraulically actuated downhole flow control valves also include certain inherent disadvantages as a result of their long hydraulic control lines which result in a delay in the application of control signals to a downhole device. In addition, the use of hydraulic fluids to control valves will not allow transmission of telemetry data from downhole monitors to controls at the surface.

To overcome some of these objections of present downhole flow control valve systems, it would be extremely helpful to be able to provide a downhole valve in which the orifice size of the valve is adjustable through a range of values. This would enable systems such as gas lift systems which are susceptible to resonant oscillation, to be detuned by adjusting the size of the orifice so that the system is no longer resonant. Changing the size of the valve flow control orifice allows the spontaneous generation of oscillations in a closed elastic fluid system to be damped and prevents the necessity of replacing the valve. In addition, such a variable orifice valve would allow much greater control over the quantity and rate of injection of fluids into the well. In particular, more precise control over the flow of injection gas into a dual lift gas lift well completion would allow continuous control of the injection pressure in both strings of tubing from a common annulus. This permits controls of production pressures and flow rates within the wells and result in more efficient production from the well.

Another desirable characteristic of a downhole flow control valve system would be that of position stability of the flow control orifice. That is, it would be highly useful to be able to set a flow control valve at a particular orifice and to have it remain at that same orifice size until selectively changed to a different size. Position stability is preferable in the absence of any control signals to the valve so that applied power is only necessary to change the orifice from one size to another. Prior art valves which are either open or closed, generally return to the closed state in the absence of control power.

Another large advantage which would be highly desirable in downhole flow control valve systems is that of an accurate system for monitoring not only the orifice size of the valve but also the pressures and flow rates within the production system in order to obtain desired production parameters within the well. For example, it would be advantageous to be able to select a particular bottom hole pressure and then control the size of the orifice of the valve in order to obtain that selected value of bottom hole pressure. Similarly, it would be desirable to be able to select a given flow rate and then control the size of the orifice of the valve in order to obtain and hold that particular flow rate of production flow from the well. Such systems require a reliable means for both sending data uphole from the vicinity of the valve as well as processing that data and then actively controlling the size of the flow control orifice of the valve in order to obtain the desired results, as monitored by the system. One implementation might include an indicator system for encoding and sending data to the surface related to valve orifice position and downhole pressure and flow information as well as a reliable system for sending signals downhole to selectively adjust the position of the valve.

The flow control valve system of the present invention incorporates many of these desired features of a valve system and allows the adjustment of a variable orifice size valve by means of signals from the surface and then the maintenance of that orifice size in a position stable configuration until additional signals are sent to change that orifice size. The system also has provisions for monitoring a plurality of parameters down in the well and then controlling the position of the valve in order to effectuate desired changes and/or maintenance in those parameter values.

SUMMARY OF THE INVENTION

The system of the present invention is related to an electric valve system for use in a well production control environment. More particularly, the invention comprises a downhole valve capable of assuming a plurality of position stable variable size orifices. The valve is controlled by signals from the surface based upon parameters of the valve, including the orifice size which can be monitored downhole and transmitted to the surface to receiving equipment. In addition, other downhole parameters such as pressures and flow rates can be monitored at the surface based upon signals generated downhole and then the orifice size of the valve changed in response thereto.

One aspect of the invention includes a system for controlling the flow of fluids within a borehole including a valve member having a flow input port, a flow discharge port and means for controlling the passage of fluid therebetween. The control means includes means capable of varying the size of the passageway between the input port and the discharge port and means for maintaining the size of the passageway at a selected value. Means is connected to the valve member for varying the size of the passageway and means is located at the surface of the borehole for supplying control signals to the varying means to control it and select the size of the passageway. The means capable of varying the size of the passageway may include a pair of rotary valve members and also a poppet valve member.

In another aspect the invention may include a downhole flow control valve system with a flow control valve for positioning within a borehole having an outer housing and a valve chamber within the housing which is in flow communication with a inlet port in the wall of the housing along with an outlet opening from the housing. A variable size orifice is located between the valve chamber and the outlet opening to control flow therebetween. The valve includes means for changing the size of the orifice over a continuous range of sizes from fully closed to fully open and energizable means for driving the orifice size changing means to selectively increase or decrease the size of the orifice. The orifice changing means is position stable to maintain the size of the orifice constant when the driving means is not energized. The system includes means at the surface for generating control signals for energizing the driving means and a control line for connecting the control signal generating means and the driving means to permit selective changes in the orifice size of the flow control valve.

BRIEF DESCRIPTION OF THE DRAWINGS

For an understanding of the present invention and for further objects and advantages thereof, reference may now be had to the following description taken in conjunction with the accompanying drawing in which.

DESCRIPTION OF THE PREFERRED EMBODIMENTS

Figure 1:
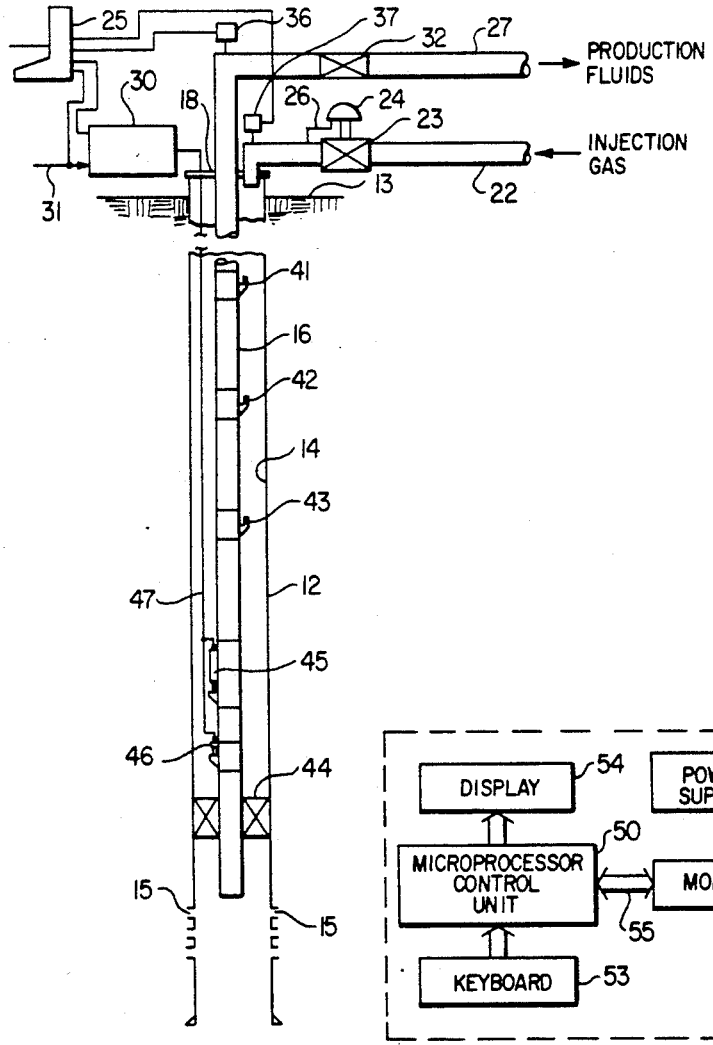
FIG. 1 is a schematic drawing of a gas injection gas lift well completion including a valve system constructed in accordance with the teachings of the present invention.

Referring first to FIG. 1, there is shown an illustrative schematic of a gas well equipped as a gas lift completion. The well includes a borehole 12 extending from the surface of the earth 13 which is lined with a tubular casing 14 and extends from the surface down to the producing geological strata. The casing 14 includes perforations 15 in the region of the producing strata to permit the flow of gas and liquid from the formation into the casing lining the borehole. The producing strata into which the borehole and the casing extend is formed of porous rock and serves as a pressurized reservoir containing a mixture of gas, oil and water. The casing 14 is preferably perforated along the region of the borehole containing the producing strata in area 15 in order to allow fluid communication between the strata and the well. A string of tubing 16 extends axially down the casing 14.

Both the tubing and the casing extend into the borehole from a wellhead 18 located at the surface above the well which provides support for the string of tubing 16 extending into the casing 14 and closes the open end of the casing. The casing 14 is connected to a line 22 which supplies high pressure gas through a first flow control valve 23 from an external source such as a compressor (not shown) into the casing 14.

The tubing 16 is connected to a production flow line 27 through a second valve 32. The output of the flow line 27 comprises production fluids from the well which are connected to a collection means such as a separator (not shown). The output flow of the tubing 16 into the production flow line 27 is generally a mixture of both liquids, such as oil, water, and condensate, and gases and is directed to a separator which effects the physical separation of the liquids from the gases and passes the gas into a sales line for delivery into a gas gathering system. The liquids output from the separator are directed into a liquid storage reservoir for subsequent disposal by well-known methods.

The computer 25 is connected to receive information from pressure transducer 36 connected in the production flow line 27 and pressure transducer 37 connected in the injection flow line 22. Both the computer 25 as well as a downhole valve controller 30 connected thereto are supplied by power from a source 31 which may be AC or DC depending upon the facilities available.

The gas lift well completion itself may include either single or multiple completions and is shown in FIG. 1 as a single completion comprising a plurality of conventional gas lift valves 41–43 connected at spaced intervals along the tubing 16 and a conventional packer 44 located just above the perforations 15. A remote control gas lift valve 45, constructed in accordance with various embodiments of the invention, is connected into the tubing 16 just above a pressure transducer 46. Both the remote control gas lift valve 45 and the pressure transducer 46 are connected via a control line 47 to the controller 30 located at the surface. The control line 47 may be electric or pressurized or a combination of both. If it is electric, it may be a two conductor, polymer insulated cable protected with a ¼ inch stainless steel tubing outer shell. The control line 47 supplies both power and operating signals to control the operation of the gas lift valve 45 through the controller 30 as well as carries information related to the operation of the gas lift valve and information from the pressure transducer to the controller 30.

Figure 2:
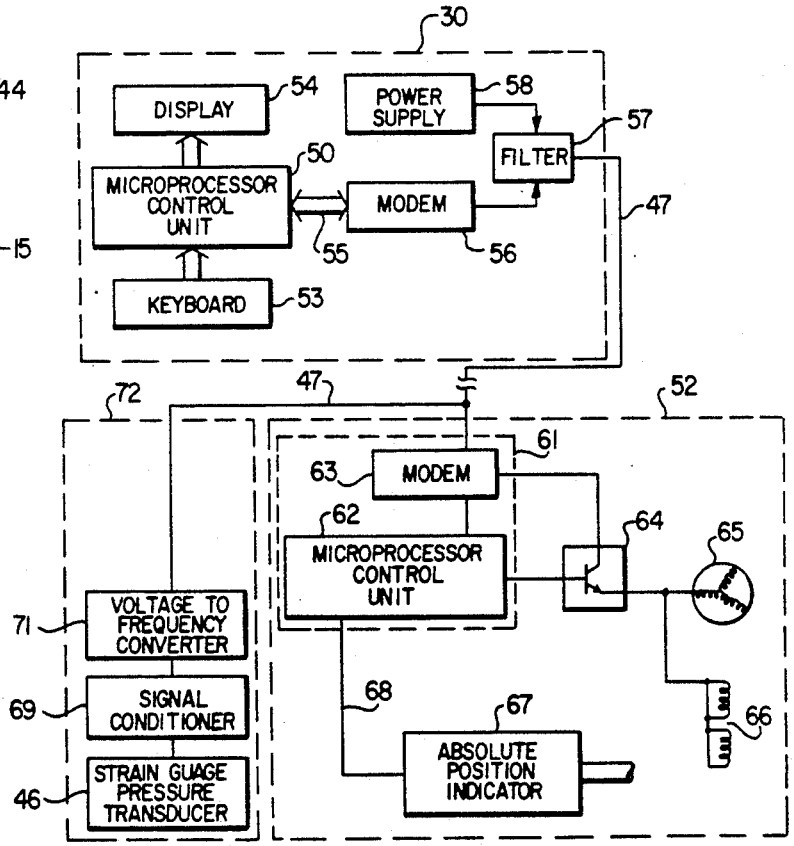
FIG. 2 is a block diagram of the electrical components of the valve system of the present invention.

Referring next to FIG. 2, there is shown a block diagram of the electrical components of the valve system of the present invention. The system includes the surface electronic package including the computer 25 and the controller 30 connected to a pair of downhole electronic packages 52 and 72 by means of the control line 47. The controller 30 includes a microprocessor control unit 50 which includes means to receive input from an operator, such as a keyboard 53, and to display various operational parameters to the operator at a visual display 54. The microprocessor control unit 50 both sends information downhole and receives information from downhole via a digital communication bus 55 connected to a modem 56 coupled to the control line 47 through a filter 57. Power is supplied to the surface electronic components by means of a power supply 58. Communications to the microprocessor control unit 50 via the modem 56 and filter 57 may be either analog or digital and, if digital, can consist of an interface employing the RS-232 serial communications protocol conventional in the industry. The data separation, modulation and transmission techniques taught in U.S. Pat. No. 4,568,933, hereby incorporated by reference, may be used in the downhole communication portion of the present system.

The downhole electronics package 52 may include a telemetry sub 61 comprising a microprocessor control unit 62 and a communications modem 63 coupled to the control line 47 for two-way communications therewith. The telemetry sub 61 is connected to a motor drive circuit 64 which controls current to either a rotary motor actuation system 65 or a linear motion actuation system controlled by a solenoid 66. As will be further described below, the electric flow control valve employed in the present invention may be provided in several different embodiments including different means of valve actuation by means of either linear o rotary drives.

The orifice size of the valve may be selectively controlled from the surface in different ways. In one embodiment a control register or potentiometer in the surface electronics package 30 may be set to a selected value representing a known condition of the orifice and then incremented or decremented as signals are sent downhole to increase or decrease the size of the orifice. In other embodiments, the flow control valve may include an absolute position indicator 67 which provides a signal indicating the absolute position of the valve orifice, through an indicator line 68, to the miroprocessor 62 for communication of that information uphole to the surface control unit 30. The subsurface electronics package 72 may include a downhole pressure transducer 46 which may take the form of a strain gauge pressure transducer, connected through a signal conditioner 69, such as an over voltage protection and a voltage to frequency converter 71, for communication of the pressure information uphole to the surface electronic control package 30 through the control line 47. In addition, other parameter measurement means such as a downhole flow rate indicator (not shown) may also be provided in the subsurface electronics package 52.

The surface eleotronic control unit 30 monitors downhole pressure information from the strain gauge pressure transducer 46 as well as information from the position indicator 67 indicating the current position of the flow control orifice of the flow control valve. Valve orifice size is monitored by the absolute position indicator 67 through the mioroprocessor control unit 62 and the modem 63 which sends the encoded data via control line 47 to the surface. In addition, the surface control electronics package 30 also sends power and control signals downhole via the control line 47, the modem 63 and microprocessor control unit 62 to control the application of power to the motor/solenoid drive circuit 64 for changing the size of the orifice of the flow control valve.

In general, the surface control unit 30 provides an interface between the computer 25, the transducers 46 and 67 downhole, the electrically controlled gas lift valve 45, and the operators of the system. The controller 30 Operates the gas lift valve 45, supplies power to the downhole components and separates the monitoring signals from the transducers 46 and 67. Information telemetered from the downhole control equipment 52 will be displayed at the display 54 of the controller 30. In addition, the computer 25 may also monitor other well parameters, such as the pressure transducers 36 and 37, and control other well components such as motor valve 23 in order to effect a coordinated well control system related to both downhole and surface operating components.

In general, several embodiments of the downhole flow control valve are employed in conjunction with the present invention. They consist of two different valve designs and three different actuator designs. Different combinations of actuators and valves may be used in particular embodiments. The two valve designs employed in the several embodiments include a non-rising stem poppet valve configuration and a rotary, lapped, shear seal valve configuration. The three actuator designs employed include a stepper motor with gear reduction, a linear solenoid with a linear to rotary motion converter, such as a wire clutch differential ratchet mechanism and indexing cam and a piston with a linear to rotary motion converter such as a wire clutch differential ratchet mechanism and indexing cam. One additional alternative design consists of a solenoid operated pilot valve controlling a servo controlled poppet valve. Each of the various embodiments of the flow control valve of the present invention are set forth below in conjunction with FIGS. 3A–3F and FIG. 13.

Figure 3A:
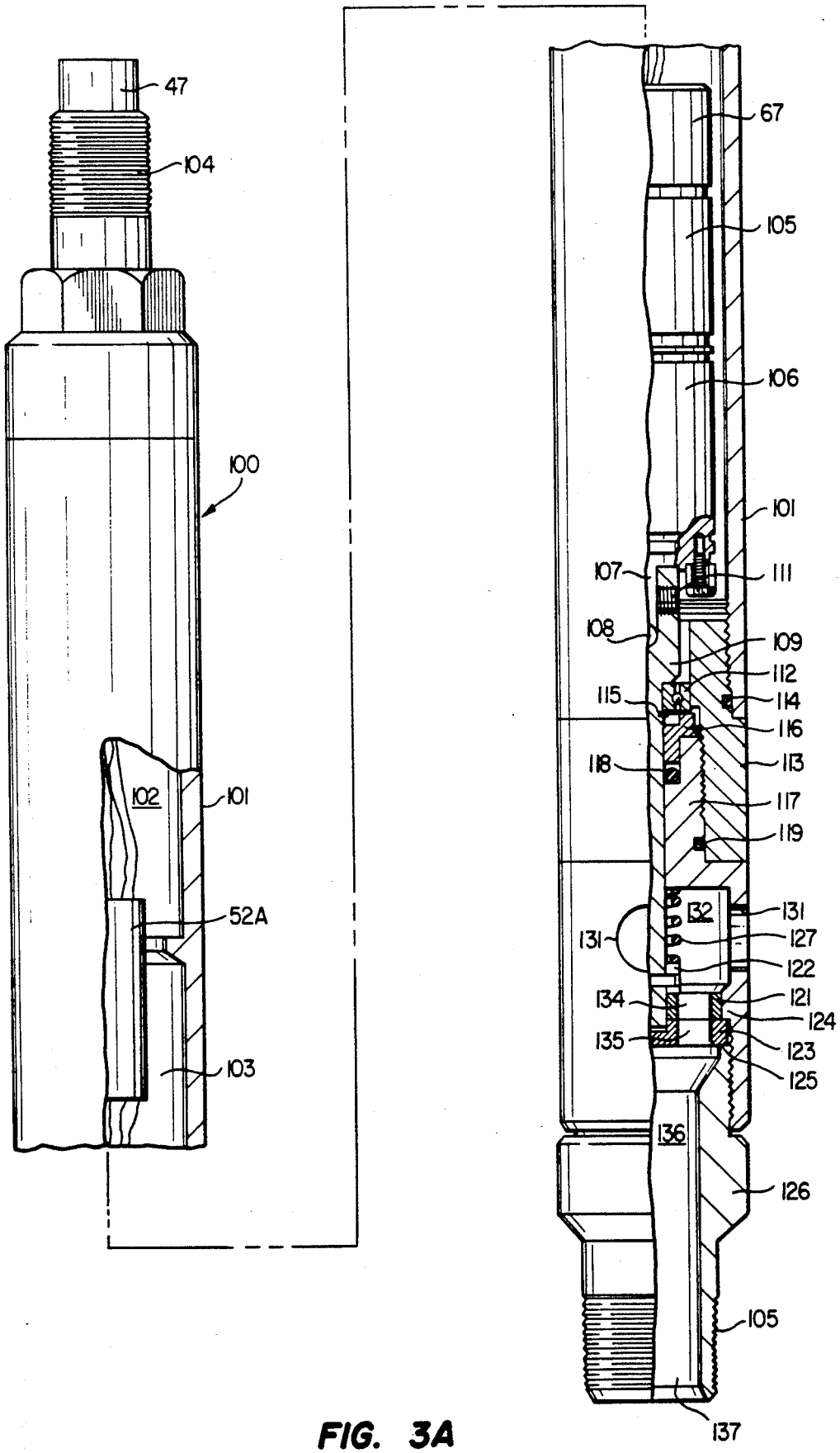
FIG. 3A is a partially cut-away and cross-sectioned view of an electric flow control valve including a motor operated rotary valve constructed in accordance with one embodiment of the present invention.

Referring next to FIG. 3A, there is shown a partially cut-away and partially longitudinally cross-sectioned view of a flow control valve constructed in accordance with one embodiment of the present invention. The valve 100 consists of an outer pressure resistant cylindrical housing 101 which includes a pair of internal chambers 102 and 103 for receiving operating components of the system. A threaded bulkhead feed through electric housing seal 104 is located in the electrical connector sub at the upper end of the valve while a threaded fluid connection 105 is located at the lower end of the valve for engagement with a coupling providing fluid communication between the valve and the interior of the well tubing. The couplings shown are for mounting on lugs welded on the outside of pup joints, i.e., conventional type gas lift mandrels. However, the mounting components of the valve could be modified for use with side pocket mandrels.

The control line 47 from the surface electronics is connected to a portion of the downhole electronics package 52A to receive control signals and deliver position information signals to the surface electronic package 30. The downhole electronics package 52A is in turn connected to an absolute position indicator 67 which ma take the form of a multi-turn potentiometer as will be further discussed below. The position indicator 67 is connected to the shaft of an electric motor such as a stepper motor 105, which is in turn connected to a speed reduction gear box 106. The position indicator 67 may also include a reduction gear with a ratio identical to that of gear box 106. The motor 105 may also be a fluid powered motor in other embodiments including a fluid power driving system. The stepper motor 105 is controlled by the subsurface electronics package 52A which translates the signals from the surface controller 30, through the two conductor cables of control line 47, to the four or five wires controlling the rotation of the motor 105. The motor 105 is controlled by powering selected pairs of the four/five wires in a specific sequence. Since there is an inherent detente braking torque in a permanent magnet stepper motor, the rotation of the valve control shaft will be position stable with the motor power off.

The output drive shaft from 107 from the speed reduction gear box 106 is connected to a receiving socket 108 formed in the upper end of a rotary drive shaft 109 and held in rigid fixed driving relationship therewith by means of a socket head set screw 111 The upper end of the rotary drive shaft 109 is journaled by a low-friction ball bearing 112 which is mounted within a bearing housing 113 and resists any axial thrust of the shaft 109. The upper end of the bearing housing 113 threadedly engages the lower end of the outer housing 101 and is sealed thereto by means of an O-ring 114. The ball bearing 112 is held in position by means of a retainer ring 115 which overlies a bushing 116 received into the upper open end of a port sub 117 which threadedly engages the lower end of the bearing housing 113. An O-ring 118 forms a seal between the lower edge of the bushing 116 and the rotary shaft 109. Another O-ring 119 seals the port sub 117 to the lower edge of the bearing housing 113. The actuation components are preferably contained in a one atmosphere chamber which is sealed by means of the several static seals and the moving seal.

The lower end of the rotary drive shaft 109 is connected to a rotary valve plate 121 by means of a spiral pin 122. As the rotary valve 121 is rotated by turning of the rotary shaft 109, it moves upon the upper surface of a stationary valve plate 123. The stationary valve plate 123 is clamped into the lower end of the port sub 117 against a radially extending shoulder 124 by means of the upper edge 125 of a bottom sub 126 which threadedly engages the lower end of the port sub 117. A helical valve spring 127 serves to exert a downward force against the upper surface of the rotary valve plate 121 to hold its lower surface in tight shear-seal engaging relationship with the upper surface of the stationary valve plate 123 to minimize leakage therebetween. The sealing action between plates 121 and 123 is a lapped wiping-type seal similar to a floating seat type of gate valve. A plurality of orthogonally located flow intake ports 13 provide openings to allow the flow of fluids from outside of the valve 100 into the generally cylindrical chamber 132 formed within the port sub 117. Fluid flows from chamber 132 and through the apertures 134 in the rotary valve plate 121 and the corresponding apertures 135 in the stationary valve plate 123 to the extent that they are axially aligned with one another. From the valve plates 121 and 123 flow moves along an axial passageway 136 through the bottom sub 126 and out the lower end 137 of the flow control valve 100.

As will be further discussed below, the shape and size of the flow ports 134 and 135 affects the size of the effective flow orifice of the valve as well as the relationship of orifice size versus the relative angle of rotation of the valve plates. The valve plate will rotate between 60 and 180 degrees ingoing from full closed to full open depending upon the number of flow ports between 1 and 3 in the valve plates.

As can be seen, rotation of the stepper motor 105 turns the output shaft 107 of the gear reducer 106 to rotate the rotary shaft 109 and thereby turn the rotary valve 121 which is connected to the lower end of the shaft. The degree to which flow ports 134 in the rotary valve plate 121 and flow ports 135 in the stationary valve plate 123 are aligned with one another determines the degree to which fluids entering the valve 100 through the flow intake ports 131 can pass through the ports 134 and 135, along the passageway 136 and out the lower end 137 of the flow control valve. The rotation of the motor 105 also turns the rotary shaft position indicator 167 which provides rotary position indication signals through the electronics 52A and the control line 47 to the surface electronics package 30 indicating the actual rotational position of the motor 105 and hence the correlated size of the effective flow orifice in the valve plates 121 and 123. As can also be seen, deenergizing the stepper motor 105 causes the flow openings through the valve plates 121 and 123 to remain position stable, i.e., they hold their orifice positions and the size of effective orifice flow which is allowed through them until further rotation of the stepper motor 105 changes the orifice size.

Figure 3B:
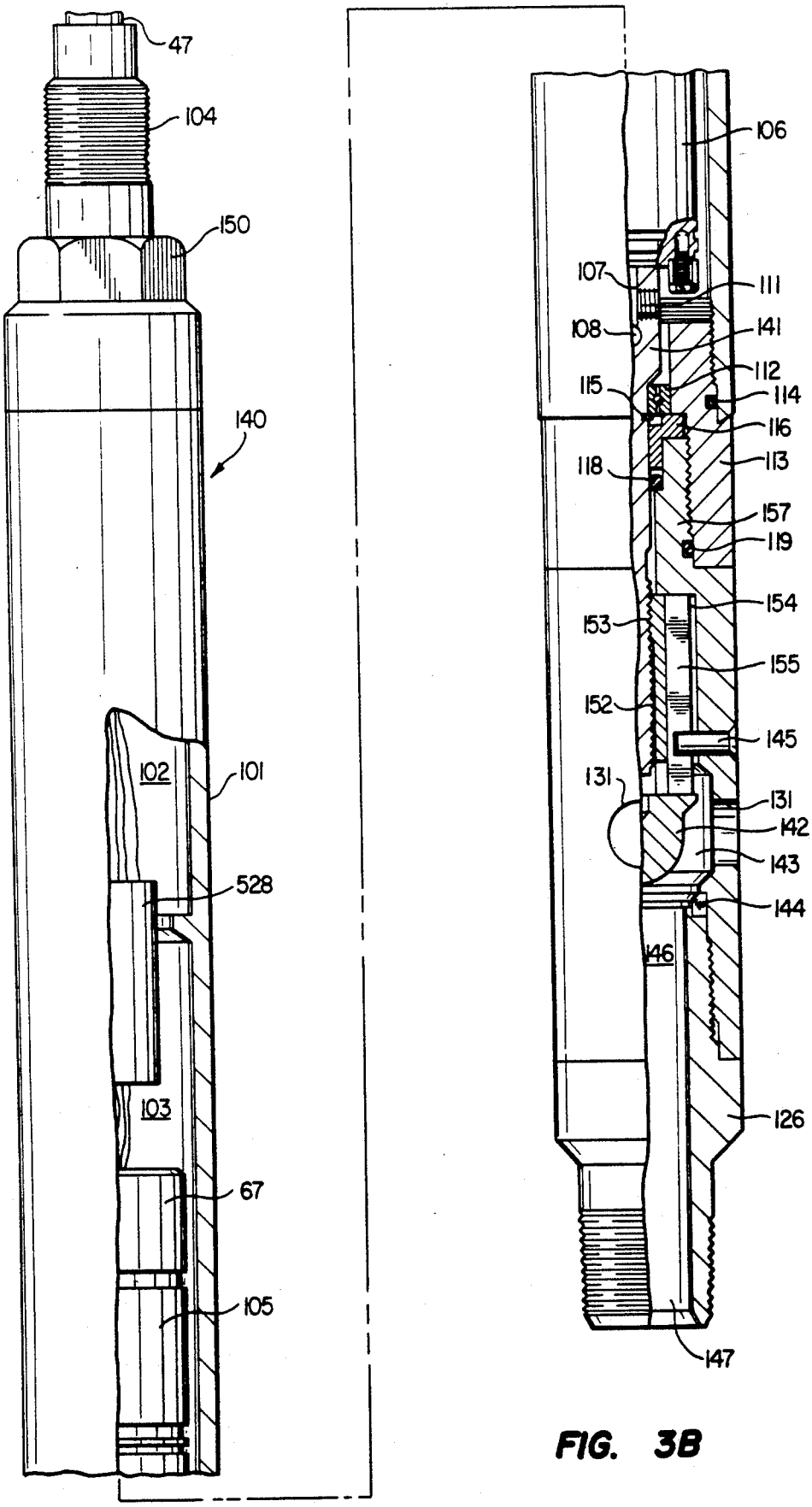
FIG. 3B is a partially cut-away and cross-sectioned view of an electric flow control valve including a motor operated poppet valve constructed in accordance with a second embodiment of the invention.

Referring next to FIG. 3B, there is shown a second embodiment of the flow control valve of the present invention which also employs a motor as a driving means but includes a nonrising stem poppet valve, rather than a rotary valve, as the actual flow control mechanism. As shown in FIG. 3B, the flow control valve 140 includes an outer housing 101 having a threaded coupling 104 at the upper end into which is received the control line 47. The line 47 enters through a bulkhead feed through electrical housing seal into the electrical connector sub 150. Within the housing 101 is contained a pair of instrument cavities 102 and 103 which houses part of the downhole electronic sub 52B. The downhole control electronics 52B are connected to a rotary absolute position indicator 67 which is connected to a stepper motor 105. The shaft of the motor 105 is connected to the shaft of the position indicator 67, such as a multi-turn potentiometer so that the indicator always produces a direct indication of the rotary position of the motor 105 which telemetered to the surface electronics 30 through the downhole electronics 52B and the control line 47. The output shaft of the stepper motor 105 is connected to a speed reduction gear box 106, the output shaft of which 107 is coupled to a socket 08 located in the upper end of a rotary drive shaft 141. The speed reducer shaft 107 is coupled to the rotary drive shaft 141 by means of a socket head set screw 111. The rotary drive shaft 141 is journaled and prevented from axial movement by means of a low friction ball bearing 112 which is received into a bearing housing 113. The upper end of the bearing housing 113 is threadedly engaged with the lower end of the housing 101 and sealed thereto by means of an O-ring 114. The ball bearing 112 is held in place by means of a retainer ring 115 and a bushing 116 which is received into the upper end of a port sub 151. The upper end of the port sub 151 is threadedly engaged into the lower end of the bearing housing 113 and sealed thereto by means of an O-ring 119. The rotary shaft 141 is sealed by means of an O-ring 118 and extends axially down through the port sub 151. The shaft 141 includes external threads 152 formed on the lower end thereof which are in threaded engagement with the internal threads of a drive insert 153 axially positioned within and affixed to a non-rising poppet valve shaft 154. The lower end of the poppet valve 154 has a poppet head 142 affixed thereto. A key slot 155 extends in the axial direction along the periphery of the valve shaft 154 and engages a pin 145 passing through the sidewall of the port sub 151. The pin 145 and slot 155 prevent the poppet valve shaft 154 from rotating within the port sub 151.

The lower end of the port sub 151 threadedly engages the upper end of a bottom sub 126, the upper edges of which mount a poppet valve seat 144. The circular edge of the seat 144 is configured to receive the outer peripheral surface of the poppet head 142 attached to the lower end of the poppet valve shaft 154 to form a seal therebetween. The valve nose of the poppet head 142 is shaped to provide a selected linear movement versus flow area relationship through the valve operating range. The lower edge of the port sub 151 contains a plurality of orthogonally located flow intake ports 131 formed through the outer wall of the valve housing and which are connected to a generally cylindrical cavity 143 in flow communication with an axial passageway 146 leading to the outlet end of the valve 147. When the poppet valve head 142 is spaced from the poppet valve seat 144, flow of fluid can occur from the outside of the valve through the flow intake port 131, the annular cavity 143, the flow passageway 146 and out the lower end 147 of the valve. Rotation of the rotary drive shaft 141 in one direction causes the threaded engagement between the lower end 152 of the shaft 141 and the internal drive threads 153 of the poppet valve shaft 154 to rotate with respect to one another. This relative rotation moves the valve shaft 154 downwardly to cause the poppet valve head 142 to come closer to the valve seat 144 restricting the flow of fluids therebetween. Continued movement of the poppet valve head 142 downwardly results in it engaging the circular edges of the seat 44 to form a seal therebetween and stop all flow between the flow intake port 31 and the valve outlet 147. Similarly, rotation of the rotary drive shaft 141 in the opposite direction moves the poppet valve head 142 in the upward direction to open the flow orifice of the valve. Positioning the poppet valve head 142 in an intermediate position with respect to the valve seat 144 causes a restriction in the flow in proportion to the distance between the valve head 142 and the valve seat 144. Thus, the rotational position of the drive shaft 141 is directly related to the flow control orifice between the poppet head 142 and the valve seal 144.

In the operation of the poppet valve mechanics of FIG. 3B there is no displacement of the poppet valve or stem into or out of the actuation chamber. This reduces the operating forces for the valve to those of: (a) the friction of one shaft seal; (b)the friction of the threads and the key pin and slot; (c) the forces to seal and unseal the valve; and (d) the flow friction forces. The poppet valve is position stable with no inherent tendency of the valve orifice to change positions without powered rotation of the stepper motor 105. In the fully closed position, the valve seats for a low leak condition. If desired the valve can also be provided with a resilient seat for improved sealing.

As can be seen, the production of electrical signals by the surface controller on the control line 47 causes the production of control signals from the downhole electronics 52B to cause rotation of the stepper motor 105, rotation of the speed gear reducer 146 and thus the rotary shaft 147. Rotation of the shaft 147 causes a change in the flow control orifice between the exterior of the valve 140 and the lower end 147 thereof. The rotational position indicator 67 is connected to the shaft of the stepper motor 105 through a reduction gear and hence its output always indicates a value which can be directly correlated to the degree of flow being allowed through the flow control valve. As can also be seen, the interruption of all current flow to the stepper motor 105 results in the relative positions between the poppet valve head 142 and the poppet valve seat 144 remaining the same. Hence the valve orifice remains in a position stable configuration until the application of additional current to the stepper motor 105 to change the flow control positions of the relative parts of the valve.

Figure 3C:
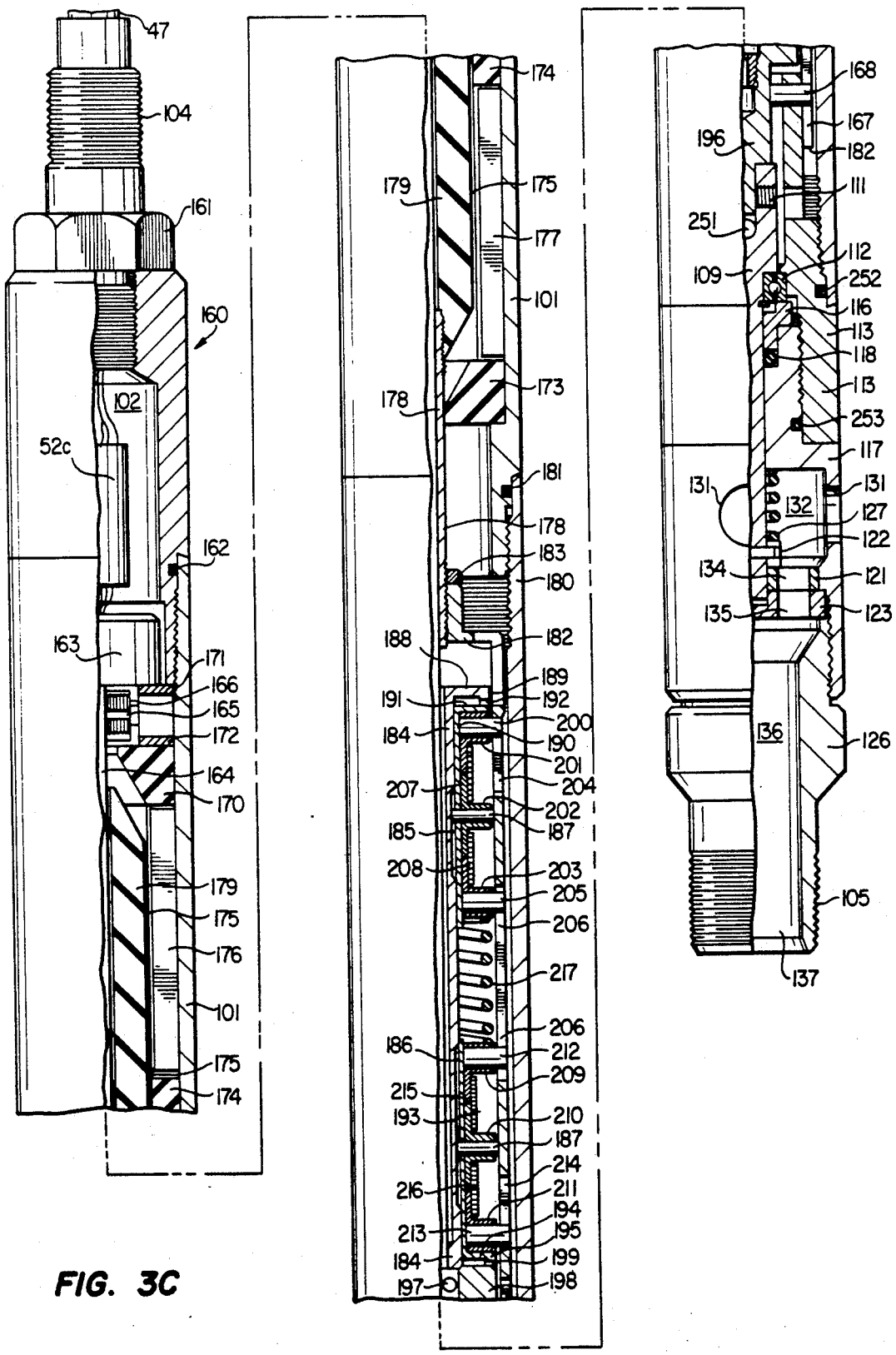
FIG. 3C is a partially out-away and cross-sectioned view of an electric flow control valve including a solenoid operated rotary valve constructed in accordance with a third embodiment of the present invention.

Referring next to FIG. 3C, there is shown a third embodiment of the flow control valve of the present invention which employs rotary flow control valve plates, as in the case of the first embodiment, but which uses a axially moving solenoid armature to provide the actuation means for rotating the valve. This is accomplished by means of a linear to rotary translation conversion mechanism within the valve body which converts the linear movements of the solenoid armature into rotary movements of the valve.

As shown in FIG. 3C, the valve 160 includes a bulkhead feed through electric housing seal to allow passage of the control line 47 into an electrical connector sub 161. The electrical connector sub 161 mounts a downhole electronics package 52C in a cavity 102 which contains the downhole electronics necessary for applying the control actuation pulses sent via the control line 47 to operate the valve. The downhole electronics 52C also sends signals from a position indicator located within the valve 160 to the surface via the control line 47 to indicate at the surface controller 30 the current position of the valve. The electrical connector sub 160 is connected to the valve housing 101 and sealed thereto by means of an O-ring 162. Within the housing 101 is a valve position indicator 163 which is connected to an indicator shaft 164. The indicator shaft 164 is connected to the indicator 163 by means of an indicator coupler 165 held in place through a set screw 166. The indicator 163 is spaced from an upper magnetic end piece 170 by means of a pair of spacers 171 and 172. Spaced between the upper magnetic end piece 170 and a lower magnetic end piece 173 is a magnetic centerpiece 174. A coil spool 175 has wound thereon an upper coil 176 and positioned between the upper end piece 170 and the magnetic centerpiece 174 and a lower coil 177 positioned between the lower magnetic end piece 173 and the magnetic centerpiece 174. A moveable solenoid armature comprises an axially moveable core nipple 178 which is attached to the lower end of a magnetic core 179.

The solenoid housing 101 is threadedly attached to an outer ratchet housing 180 and sealed thereto by means of an O-ring 181. The lower end of the core nipple 178 is threadedly attached to the upper end of a cam sleeve 182 and held against movement by means of a clamp nut 183. The indicator rod 164 extends axially down through the core nipple 178 and is affixed to a stem extension 184. The stem extension 184 includes a pair of axially spaced, circumferentially extending recesses 185 and 186 which receive and allow axial movement of a pair of dowel pins 187.

The upper end of the stem extension 184 has a circular radially extending flange 188 which includes a downwardly facing outer edge portion 189 with radially extending teeth formed thereon. An upper clutch sleeve 190 includes an elongate tubular shaft which is journaled upon the stem extension 184 for relative movement in both circumferential directions. The upper end of the upper clutch sleeve 190 includes a circular radially extending flange 91 which has an upwardly facing outer edge portion 192 with radially extending teeth thereon. When the radial teeth in the downwardly facing edge portion 189 of the stem extension flange edge 88 engage the radial teeth in the upwardly facing edge portion 192 of the upper clutch sleeve flange 191 the two parts move together as a unit in the circumferential direction. The opposed sets of radial teeth formed in the clutch plates are preferably each formed with the angle of the teeth approximating the cam angle to prevent camming apart of the teeth during operation. When the two sets of radial teeth are spaced from one another the upper clutch sleeve 190 moves freely about the stem extension shaft in both circumferential directions.

An identical lower clutch sleeve 193 has an elongate tubular shaft which is journaled upon the lower portion of the stem extension 184 for relative movement in both circumferential directions. The lower end of the lower clutch sleeve 193 includes a circular radially extending flange 194 which has a downwardly facing outer edge portion 195 with radially extending teeth thereon. The lower end of the stem extension is threadedly coupled to the upper end of a stem 196 and held in secure engagement therewith by a set screw 197. The lower end of the cam sleeve 182 overlies most of the stem 196 and includes a longitudinal slot 167 which is open at the lower end to receive the dowel pin 168. The upper end of the stem 196 has a circular radially extending shoulder 198 which includes an upwardly facing outer edge portion 199 with radially extending teeth. When the angularly formed radial teeth of the upwardly facing edge portion 199 of the stem shoulder 198 engage the angularly formed radial teeth in the downwardly facing edge portion 195 of the lower clutch sleeve flange 194 the two parts, along with the stem extension 184, move together in the ciroumferential direction. When the two sets of radial teeth are spaced from one another, the lower clutch sleeves 193 moves freely about the stem extension shaft in both circumferential directions.

Overlying and journaled upon the outer surface of the tubular shaft of the upper clutch sleeve 190 are an upper end drum 201, a center drum 202 and a lower end drum 203. The upper end drum 201 includes a dowel pin 200 which is received into an upper longitudinally extending slot 204 in the cam sleeve 182. The center drum 202 includes a dowel pin 187 which extends through an aperture in the upper clutch sleeve 190 to rigidly connect it therewith and into the upper recess 185 in the stem extension 184. The lower end drum 203 includes a dowel pin 205 which is received into a central longitudinally extending slot 206 in the cam sleeve 182. A helical clutch spring with left hand windings 207 overlies and engages the cylindrical outer surfaces of both the upper end drum 201 and the upper portion of the center drum 202. A similar helical clutch spring with right hand windings 208 overlies and engages the cylindrical outer surfaces of both the lower end drum 203 and the lower portion of the center drum 202.

Overlying and journaled upon the outer surface of the tubular shaft of the lower clutch sleeve 193 are an upper end drum 209, a center drum 210 and a lower end drum 211. The upper end drum 109 includes a dowel pin 212 which is received into the central longitudinally extending slot 206 in the cam sleeve 182. The center drum 210 includes a dowel pin 187 which extends through an aperture in the lower clutch sleeve 193 to rigidly connect it therewith and into the lower recess 186 in the stem extension 184. The lower end drum 203 includes a dowel pin 213 which is received into a lower longitudinally extending slot 214 in the cam sleeve 182. A helical clutch spring with left hand windings 215 overlies and engages the cylindrical outer surfaces of both the upper end drum 209 and the upper portion of the center drum 210. A similar helical clutch spring with a right hand winding 216 overlies and engages the cylindrical outer surfaces of the lower end drum 211 and the lower portion of the center drum 210.

A helical coil spring 217 is compressed between the radially extending flanged end of the lower end drum 203 and the radially extending flanged end of the upper end drum 209. The biasing force of spring 217 holds the dowel pin 200 in the upper end of slot 204 and the teeth on the upper surface of the outer edge portion 192 of upper clutch sleeve 190 in driving engagement with the teeth on the lower surface of the outer edge portion 189 of stem extension 184. Similarly, the biasing force of spring 217 holds the dowel pin 213 in the lower end of slot 214 and the teeth in the lower surface of the outer edge portion 195 of the lower clutch sleeve 193 in driving engagement with the teeth on the upper surface of the outer edge portion 199 of the stem 196. Downward movement of dowel pin 200 will disengage the upper sets of teeth on edge portions 192 and 189 while leaving the lower sets of teeth on edge portions 195 and 199 in driving engagement with one another. Similarly, upward movement of dowel pin 213 will disengage the lower sets of teeth on edge portions 195 and 199 while leaving the upper sets of teeth on edge portions 192 and 189 in driving engagement with one another.

Figure 7:
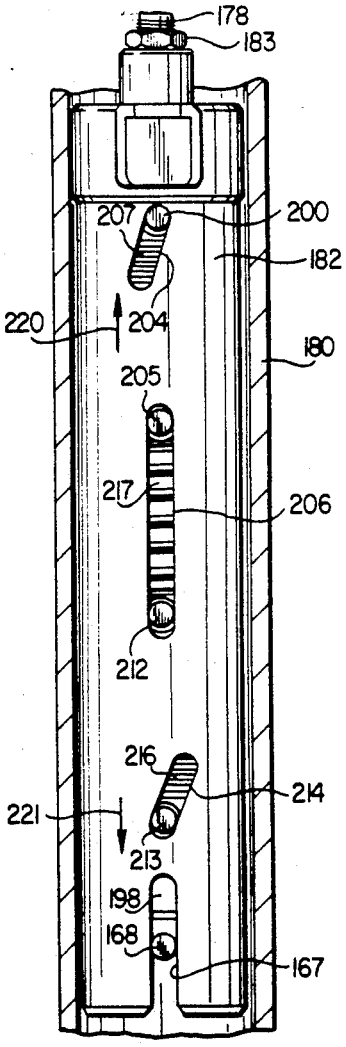
FIG. 7 is a cross-section view of a cam sleeve mechanism used in the clutch system embodiment of the present valve.

Referring briefly to FIG. 7, there can be seen how the cam sleeve 182 overlies and encloses the spring and clutch mechanisms described above. The upper slot 204 in the cam sleeve 182 which receives the dowel pin 200 is angled downwardly and to the left while the lower slot 214 in the cam sleeve 82 which receives dowel pin 213 is angled upwardly and to the right. The central slot 206 in the cam sleeve 182 which receives dowel pins 205 and 212 extends parallel to the longitudinal axis of the sleeve 182. Alternatively, the stroke length of the cam sleeve 182 may be adjusted by screwing the core nipple 178 into and out of the threads in the top of the cam sleeve. Changing the stroke length of the cam sleeve 182 in one direction over the other changes the relative distance of angular relation in one direction over the other direction on each stroke. Either of these two alternative features enable selection of the size of the valve flow orifice in very small increments of value as will be further explained below.

The lower end of the stem 196 is rigidly affixed into a socket 251 in the upper end of a rotary drive shaft 109 by means of a socket head screw 111. The upper end of the drive shaft 109 is journaled by means of a ball bearing 112 held in position by a retainer ring 115 and overlying a bushing 116. The ratchet housing 180 is threadedly attached to a bearing housing 113 and sealed thereto by means of an O-ring 252. The bearing housing 113 is, in turn, sealed to a rotary port sub 117 by means of an O-ring 253. The lower end of the drive shaft 109 is sealed by an O-ring 118 and connected to a rotary valve plate 121 by means of a spiral pin 122. The rotary valve plate 121 overlies a stationary valve plate 123. A valve spring 127 holds the rotary valve plate 121 in flush shear sealing engagement with the stationary valve plate 123. A plurality of orthogonally arranged flow intake ports 131 form a passageway between the exterior of the valve and an interior cavity 132. A plurality of flow ports 134 formed through the rotary valve plate 121 may be aligned with a matching plurality of flow ports 135 in the stationary valve plate 123 to control the flow of fluids from the exterior of the valve through the flow intake port 131, into the valve cavity 132, through the aligned ports 134 and 135 along an axially flow passage 126 and out the lower end of the valve 137. The bottom sub 126 is coupled to the lower end of the port sub 127 by means of threaded engagement. Thread 105 on the exterior of the bottom sub 126 enables coupling of the valve into other components.

This embodiment of the flow control valve has a linear solenoid driving an indexing cam sleeve which rotates a shaft through a wire clutch differential ratchet mechanism. By selecting the polarity of an applied electrical pulse at the surface, the solenoid can be selectively energized to either push or pull on the cam sleeve 82 to index the differential ratchet a portion of a revolution and a spring returns the sleeve to the center position. When no power is applied to the solenoid the valve actuator is prevented from turning so that the valve orifice is position stable in the unpowered condition.

As can be seen from FIGS. 3C and 7, energization of the coil 176 with an electrical pulse pulls the magnetic core 179 upwardly from a center position toward the upper magnetic end piece 170 while energization of the coil 177 with an electrical pulse pulls the core 179 toward the lower magnetic end piece 173. The particular coil 176 or 177 is selected for energization, by a pair of reverse connected diodes, in response to a pulse of one polarity or the other. Spring 217 keeps the core 179 in approximately the center position. Movement of the magnetic core 179 causes movement of the core nipple 178 in the axial direction moving the cam sleeve 182 in the same axial direction.

Movement of the cam sleeve 182 upwardly, in the direction of arrow 220, causes the dowel pin 200 to follow the slot 204 and move circumferentially in the clockwise direction, looking down. Such movement of the cam sleeve 182 moves the dowel pin 213 upwardly which lifts dowel pin 187 and the lower clutch sleeve 193 to disengage the lower sets of teeth on edge portions 195 and 199 to allow stem extension 184 to rotate with respect to the lower clutch sleeve 193. Upward movement of the cam sleeve 182 also moves the dowel pin 212 upwardly to maintain the compression on the spring 217 which holds the upper sets of teeth on edge portions 189 and 192 in driving engagement with one another. Circumferential movement of the dowel pin 200 in the clockwise direction the incremental distance by which the upper and lower ends of slot 204 are circumferentially displaced from one another, also rotates the upper end drum 201 through the same incremental distance. Rotation of the upper end drum 201 causes the left hand wound spring 207 to grip the center drum 202 and rotate it which moves dowel pin 187 and the upper clutch sleeve 190. The right hand wound spring 208 slips to prevent rotation of the center drum 202 from rotating the lower end drum 203. The driving engagement between the teeth on edge portion 192 of upper clutch sleeve 190 and edge portion 189 of the stem extension 184 produces an incremental rotation of the stem extension 84 and the stem 196 to which it is coupled. Rotation Of the stem 196 rotates the drive shaft 109 and the upper valve plate 121 and changes the effective flow orifice of the valve an incremental amount. Return downward movement of the cam sleeve 182 to its neutral position, shown in FIG. 7, is produced by the bias of spring 217 and causes downward movement of the dowel pin 213 which reconnects the driving engagement between the lower clutch sleeve 194 and the stem 196. Return downward movement of cam sleeve 182 also causes dowel pin 200 to follow the upper slot 204 and move circumferentially an incremental distance in the counter clockwise direction, looking down. Such movement of pin 200 rotates the upper end drum 201 but, because of slippage of the left hand spring 207, the center drum 202 does not rotate and the upper clutch sleeve 190 does not rotate so that the stem extension 184, the stem 196, the rotary shaft 109 and the upper valve plate 121 remain where they were and the flow control orifice is not changed.

Similarly, movement of the cam sleeve downwardly, in the direction of arrow 221, causes the dowel pin 213 to follow the slot 214 and move circumferentially in the counter-clockwise direction, looking down. Such movement of the cam sleeve 182 moves the dowel pin 200 downwardly which pulls dowel pin 187 and the upper clutch sleeve 190 downwardly to disengage the upper sets of teeth on edge portions 189 and 192 to allow stem extension 184 to rotate with respect to the upper clutch sleeve 191. Downward movement of the cam sleeve 182 also moves the dowel pin 205 downwardly to maintain the compression on the spring 217 which holds the lower set of teeth on edge portions 195 and 199 in driving engagement with one another. Circumferential movement of the dowel pin 213 in the counter-clockwise direction incremental distance by which the upper and lower ends of slot 214 are ciroumferentially displaced from one another, also rotates the lower end drum 211 through the same incremental distance. Rotation of the lower end drum 211 causes the right hand wound spring 216 to grip the center drum 210 and rotate it which moves dowel pin 187 and lower clutch sleeve 194. The driving engagement between the teeth on edge portions 195 on lower clutch sleeves 194 and edge portion 199 of the stem 196 produces an incremental rotation of the stem 196. Rotation of the stem 196 rotates the drive shaft 109 and the upper valve plate 121 and changes the effective flow orifice of the valve an incremental amount.

Return upward movement of the cam sleeve 182 to its neutral position, shown in FIG. 7, is produced by the bias of spring 217 and causes upward movement of dowel pin 200 to reconnect the driving engagement between the upper clutch sleeve 191 and the stem extension 184. Return upward movement of cam sleeve 182 also causes dowel pin 213 to follow the lower slot 214 and move circumferentially an incremental distance in the clockwise direction, looking down. Such movement of pin 213 rotates the lower end drum 211 but, because of slippage of the right hand spring 215 the center drum 210 does not rotate and the lower clutch sleeve 194 does not rotate so that the stem 196, the rotary shaft 109 and the upper valve plate 121 remain where they were and the flow control orifice is not changed.

It should be noted that the incremental distance in the circumferential direction by which the stem 196 moves in the counter-clockwise direction, looking down, in response to an upward movement of the cam sleeve 182 will be slightly greater than the incremental distance in the circumferential direction by which the stem 196 moves in the clockwise direction in response to a downward movement of the cam sleeve. This is because of the slight difference in slant angle between slots 204 and 214 from the axis of the cam sleeve 192. Alternatively, as mentioned, the stroke distance of cam sleeve 182 may be adjusted to produce a comparable result. This angular difference enables effective incremental movements of the rotary drive shaft 109 which are as small as the difference between the two circumferential movements in the opposite directions. Selective adjustment is accomplished by one or more movements in one direction followed by a selected number of movements in the opposite direction. The effective movement of the drive shaft is the difference between sum of the incremental movements in each direction.

As can be seen from the above description, each axial movement of the magnetic core 179 in the upward direction produces rotational movement of the rotary valve plate 121 in one direction while each axial movement of the core 179 in the downward direction causes rotational movement of the rotary valve plate 121 in the opposite direction. The rotational movement of the rotary valve plate 121, with respect to the stationary valve plate 123, occurs in a series of individual increments which are a function of the number and direction of the axial movements in the core 179. Thus, pulsing the solenoid windings of the core 179 causes it to perform one or more successive movements from its center position to either an upward or downward position, depending upon the polarity of the pulse, and then return to the center position. These movements cause successive rotational movements in the rotary valve plate 121. When the core 179 is stationary, the rotary valve plate 121 is also stationary and position stable with respect to its given position. Rotational movement of the rotary drive shaft 109 similarly rotates the indicator shaft 164 to rotate the shaft of the indicator 163 and thus provide an uphole indication, through the downhole electronics 52C and the control line 47, of the position of the rotary valve plate 121, and, hence, the effective valve orifice size. Alternatively, a register can be used to maintain a count of the number and polarity of the pulses applied to the solenoid and thereby maintain a continuous indication of the effective valve orifice size from a calibrated reference value.

As can be seen, the solenoid actuating mechanism initially takes movement in the axial direction and translates that into rotational movement by virtue of the linear to rotational movement translation portion of the third embodiment of the flow control valve shown in FIG. 3C.

Figure 3D:
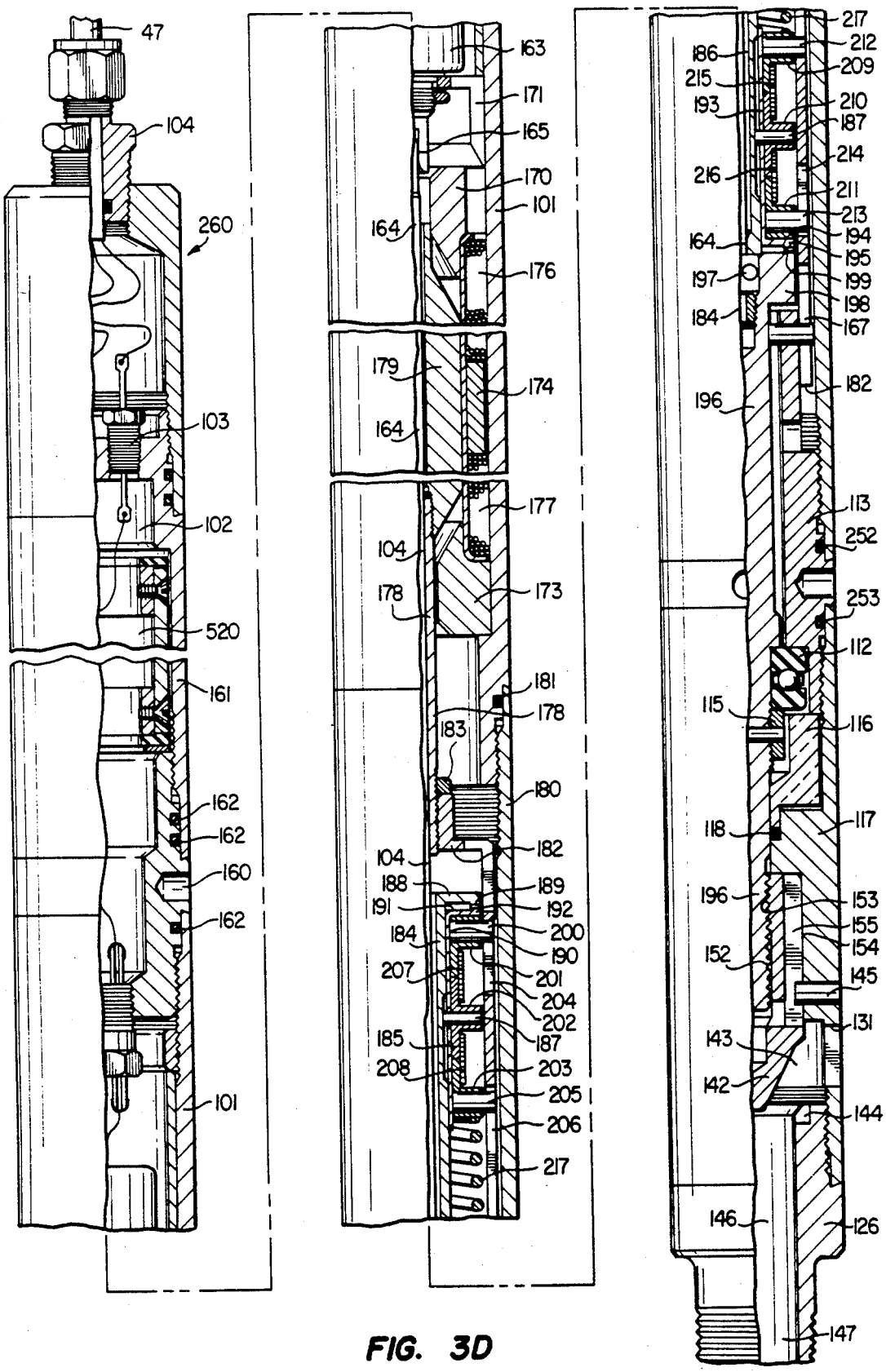
FIG. 3D is a partially cut-away and cross-sectioned view of an electric flow control valve including a solenoid operated poppet valve constructed in accordance with a fourth embodiment of the present invention.

Referring next to FIG. 3D, there is shown a poppet flow control valve which incorporates the solenoid actuated rotating mechanism, incorporated in the third embodiment of FIG. 3C, with a poppet type valve closure structure to produce a fourth embodiment of the flow control valve of the present invention. As shown therein, a valve 260 includes a bulkhead feed through electric housing seal 104 connecting with a top housing which receives and seals the control line 47 against well bore fluids. The electrical leads are connected through second feed through sealing connectors 103 into chamber 102 which houses the downhole electronics package 52D. The electronic connector sub 161 is coupled through a bulkhead sub 160 to a coil housing sub 101 by means of threaded interconnections and seals comprising O-rings 162. A position indicator 163 includes an indicator rod 164 coupled to the shaft thereof for rotational movement. A valve position indicator 163 is coupled to an indicator rod 164 by means of a shaft coupler 65 and mounted by means of a potentiometer bulkhead 171. An upper magnetic end piece 170 and a lower magnetic end piece 173 are separated by means of a magnetic centerpiece 174. A coil spool 175 extends between the upper and lower magnetic end pieces 170 and 173 and has an upper coil 176 located between the upper magnetic end piece and the magnetic centerpiece 174 and a lower coil 177 located between the lower magnetic end piece and the 173 and the magnetic centerpiece 174. A magnetic core 179 is mounted for axial movement in response to the direction of flow of current through the upper coil 176 and the lower coil 177.

The lower end of the magnetic core 179 is threadedly attached to the upper end of a core nipple 178 the lower end of which is threadedly mounted to the upper end of a cam sleeve 182 and clamped thereto by means of a nut 183. The indicator rod 164 extends axially down through the core nipple 178 and is affixed to a stem extension 184. The stem extension 184 includes a pair of axially spaced, circumferentially extending recesses 185 and 186 which receive and allow movement of a pair of dowel pins 187.

The upper end of the stem extension 184 has a circular radially extending flange 188 which includes a downwardly facing outer edge portion 189 with radially extending teeth formed thereon. An upper clutch sleeve 190 includes an elongate tubular shaft which is journaled upon the stem extension 184 for relative movement in both circumferential directions. The upper end of the upper clutch sleeve 190 includes a circular radially extending flange 191 which has an upwardly facing outer edge portion 192 with radially extending teeth thereon. When the radial teeth in the downwardly facing edge portion 189 of the stem extension flange edge 188 engage the radial teeth in the upwardly facing edge portion 192 of the upper clutch sleeve flange 191 the two parts move together as a unit in the circumferential direction. The teeth on the face of the opposed clutch plates are preferably angled as described above. When the two sets of radial teeth are spaced from one another the upper clutch sleeve 190 moves freely about the stem extension shaft in both circumferential directions.

An identical lower clutch sleeve 193 has an elongate tubular shaft which is journaled upon the lower portion of the stem extension 184 for relative movement in both circumferential directions. The lower end of the lower clutch sleeve 193 includes a circular radially extending flange 194 which has a downwardly facing outer edge portion 195 with radially extending teeth thereon. The lower end of the stem extension is threadedly coupled to the upper end of a stem 196 and held in secure engagement therewith by a set screw 197. The lower end of the cam sleeve 182 overlies most of the stem 196 and includes a longitudinal slot 167 which is open at the lower end to receive the dowel pin 168. The upper end of the stem 196 has a circular radially extending shoulder 198 which includes an upwardly facing outer edge portion 199 with radially extending teeth. When the angled radial teeth of the upwardly facing edge portion 199 of the stem shoulder 198 engage the angled radial teeth in the downwardly facing edge portion 195 of the lower clutch sleeve flange 194 the two parts, along with the stem extension 184, move together in the circumferential direction. When the two sets of radial teeth are spaced from one another, the lower clutch sleeves 193 moves freely about the stem extension shaft in both circumferential directions.

Overlying and journaled upon the outer surface of the tubular shaft of the upper clutch sleeve 190 are an upper end drum 201, a center drum 202 and a lower end drum 203. The upper end drum 201 includes a dowel pin 200 which is received into an upper longitudinally extending slot 204 in the cam sleeve 182. The center drum 202 includes a dowel pin 187 which extends through an aperture in the upper clutch sleeve 190 to rigidly connect it therewith and into the upper recess 185 in the stem extension 184. The lower end drum 203 includes a dowel pin 205 which is received into a central longitudinally extending slot 206 in the cam sleeve 182. A helical clutch spring with left hand windings 207 overlies and engages the cylindrical outer surfaces of both the upper end drum 201 and the upper portion of the center drum 202. A similar helical clutch spring with right hand windings 208 Overlies and engages the cylindrical outer surfaces of both the lower end drum 203 and the lower portion of the center drum 202.

Overlying and journaled upon the outer surface of the tubular shaft of the lower clutch sleeve 193 are an upper end drum 209, a center drum 210 and a lower end drum 211. The upper end drum 109 includes a dowel pin 212 which is received into the central longitudinally extending slot 206 in the cam sleeve 182. The center drum 210 includes a dowel pin 187 which extends through an aperture in the lower clutch sleeve 193 to rigidly connect it therewith and into the lower recess 186 in the stem extension 184. The lower end drum 203 includes a dowel pin 213 which is received into a lower longitudinally extending slot 214 in the cam sleeve 182. A helical clutch spring with left hand windings 215 overlies and engages the cylindrical outer surfaces of both the upper end drum 209 and the upper portion of the center drum 210. A similar helical clutch spring with a right hand winding 216 overlies and engages the cylindrical outer surfaces of the lower end drum 211 and the lower portion of the center drum 210.

A helical coil spring 217 is compressed between the radially extending flanged end of the lower end drum 203 and the radially extending flanged end of the upper end drum 209. The biasing force of spring 217 holds the dowel pin 200 in the upper end of slot 204 and the teeth on the upper surface of the outer edge portion 192 of upper clutch sleeve 190 in driving engagement with the teeth on the lower surface of the outer edge portion 189 of stem extension 184. Similarly, the biasing force of spring 217 holds the dowel pin 213 in the lower end of slot 214 and the teeth in the lower surface of the outer edge portion 195 of the lower clutch sleeve 193 in driving engagement with the teeth on the upper surface of the outer edge portion 199 of the stem 196. Downward movement of dowel pin 200 will disengage the upper sets of teeth on edge portions 192 and 189 while leaving the lower sets of teeth on edge portions 195 and 199 in driving engagement with one another. Similarly, upward movement of dowel pin 213 will disengage the lower sets of teeth on edge portions 195 and 199 while leaving the upper sets of teeth on edge portions 192 and 189 in driving engagement with one another.

Referring briefly to FIG. 7, there can be seen how the cam sleeve 182 overlies and encloses the spring and clutch mechanisms described above. The upper slot 204 in the cam sleeve 182 which receives the dowel pin 200 is angled downwardly and to the left while the lower slot 214 in the cam sleeve 182 which receives dowel pin 213 is angled upwardly and to the right. The central slot 206 in the ca sleeve 182 which receives dowel pins 205 and 212 extends parallel to the longitudinal axis of the sleeve 182. As can be seen from FIG. 7, the incremental distance in the circumferential direction by which the upper and lower ends of the lower slot 214 are separated from one another is slightly greater than the incremental distance in the circumferential direction by which the upper and lower ends of the upper slot 204 are separated from one another. This feature and the alternative feature of adjusting the cam sleeve stroke length described above, enable selection of the size of the valve flow orifice in very small increments of value as will be further explained below.

Movement of the cam sleeve 182 upwardly, in the direction of arrow 220, causes the dowel pin 200 to follow the slot 204 and move circumferentially in the clockwise direction, looking down. Such movement of the cam sleeve 182 moves the dowel pin 213 upwardly which lifts dowel pin 187 and the lower clutch sleeve 193 to disengage the lower sets of teeth on edge portions 195 and 199 to allow stem extension 184 to rotate with respect to the lower clutch sleeve 193. Upward movement of the cam sleeve 182 also moves the dowel pin 212 upwardly to maintain the compression on the spring 217 which holds the upper sets of teeth on edge portions 189 and 192 in driving engagement with one another. Circumferential movement of the dowel pin 200 in the clockwise direction the incremental distance by which the upper and lower ends of slot 204 are circumferentially displaced from one another, also rotates the upper end drum 201 through the same incremental distance. Rotation of the upper end drum 201 causes the left hand wound spring 207 to grip the center drum 202 and rotate it which moves dowel pin 187 and the upper clutch sleeve 190. The right hand wound spring 208 slips to prevent rotation of the center drum 202 from rotating the lower end drum 203. The driving engagement between the teeth on edge portion 192 of upper clutch sleeve 90 and edge portion 189 of the stem extension 184 produces an incremental rotation of the stem extension 184 and the stem 196 to which it is coupled. Rotation of the stem 196 rotates the drive shaft 109 and the upper valve plate 21 and changes the effective flow orifice of the valve an incremental amount.

Return downward movement of the cam sleeve 182 to its neutral position, shown in FIG. 7, is produced by the bias of spring 217 and causes downward movement of the dowel pin 213 which reconnects the driving engagement between the lower clutch sleeve 194 and the stem 196. Return downward movement of cam sleeve 182 also causes dowel pin 200 to follow the upper slot 204 and move circumferentially an incremental distance in the counter clockwise direction, looking down. Such movement of pin 200 rotates the upper end drum 201 but, because of slippage of the left hand spring 207 the center drum 202 does not rotate and the upper clutch sleeve 190 does not rotate so that the stem extension 184, the stem 196, the rotary shaft 109 and the upper valve plate 121 remain where they and the flow control orifice is not changed.

Similarly, movement of the cam sleeve downwardly, in the direction of arrow 221, causes the dowel pin 213 to follow the slot 214 and move circumferentially in the counter-clockwise direction, looking down. Such movement of the cam sleeve 182 moves the dowel pin 200 downwardly which pulls dowel pin 187 and the upper clutch sleeve 190 downwardly to disengage the upper sets of teeth on edge portions 189 and 192 to allow stem extension 184 to rotate with respect to the upper clutch sleeve 191. Downward movement of the cam sleeve 182 also moves the dowel pin 205 downwardly to maintain the compression on the spring 217 which holds the lower set of teeth on edge portions 195 and 199 in driving engagement with one another. Circumferential movement of the dowel pin 213 in the counter-clockwise direction the incremental distance by which the upper and lower ends of slot 214 are circumferentially displaced from one another, also rotates the lower end drum 211 through the same incremental distance. Rotation of the lower end drum 211 causes the right hand wound spring 216 to grip the center drum 210 and rotate it which moves dowel pin 187 and lower clutch sleeve 194. The driving engagement between the teeth on edge portions 195 on lower clutch sleeves 194 and edge portion 199 of the stem 196 produces an incremental rotation of the stem 196. Rotation of the stem 196 rotates the drive shaft 109 and the upper valve plate 121 and changes the effective flow orifice of the valve an incremental amount.

Return upward movement of the cam sleeve 182 to its neutral position, shown in FIG. 7, is produced by the bias of spring 217 and causes upward movement of dowel pin 200 to reconnect the driving engagement between the upper clutch sleeve 191 and the stem extension 184. Return upward movement of cam sleeve 182 also causes dowel pin 213 to follow the lower slot 214 and move circumferentially an incremental distance in the clockwise direction, looking down. Such movement of pin 213 rotates the lower end drum 211 but, because of slippage of the right hand spring 215 the center drum 210 does not rotate and the lower clutch sleeve 194 does not rotate so that the stem 196, the rotary shaft 109 and the upper valve plate 121 remain where they were and the flow control orifice is not changed.

It should be noted that the incremental distance in the circumferential direction by which the stem 196 moves in the counter-clockwise direction, looking down, in response to an upward movement of the cam sleeve 182 will be slightly greater than the incremental distance in the circumferential direction by which the stem 196 moves in the clockwise direction in response to a downward movement of the cam sleeve. This is because of the difference in stroke length of the cam sleeve, as described above, or because of the slight difference in slant angle between slots 204 and 214 from the axis of the cam sleeve 192. This angular different enables effective incremental movements of the rotary drive shaft 109 which are as small as the difference between the two circumferential movements in the opposite directions. Selective adjustment is accomplished by one or more movements in one direction followed by a selected number of movements in the opposite direction. The effective movement of the drive shaft is the difference between sum of the incremental movements in each direction.

The ratchet housing 180 is threadedly engaged to the bearing housing 113 and sealed thereto by means of an 0-ring 252. The rotary drive shaft comprising the stem 196 is journaled by means of a ball bearing 112 held in place by a retainer ring 115 and a bearing bushing 116. The bushing is held in place by means of the upper edges of a port sub 117 which threadedly engages the bearing housing 113 and is sealed thereto by means of an 0-ring 253.

The lower end of the stem 196 is externally threaded at 152 and engages the internal threads of a drive thread 153 of a nonrising stem poppet valve shaft 154. A longitudinally extending slot 155 is formed along the length of the valve shaft 154 and is engaged by a spiral pin 145 extending through the wall of the rotary port sub 117 to prevent rotation of the valve shaft 154. The lower end of the valve shaft 154 has formed thereon a poppet head 142 which is located for engagement with a poppett valve seat 144. The valve seat 144 is held in place at the upper end of a bottom sub 126 which threadedly engages the lower end of the rotary port sub 117. A plurality of orthogonally located flow intake ports 131 are formed in the outer wall of the rotary port sub 117 and communicate with an internal cavity 143 within which is mounted the poppet valve head 142. The cavity 143 is in fluid communication with a longitudinally extending passageway 146 which joins the exit opening 147 at the lower end of the bottom sub 126. Rotation of the stem 196 in one direction causes the threaded drive 153 within the poppet valve shaft 154 to move the poppet head 142 downwardly toward the seat 144 and close the opening therebetween. Rotation of the stem 196 in the opposite direction causes movement of the poppet head 142 in the upward direction and, hence, opens the spacing between the valve seat 144 and the poppet head 142 to allow an additional amount of flow through the variable orifice of the valve. The poppet head 142 in this embodiment is shown to have a generally conical outer surface to produce a relatively linear relationship between change in head position and change in valve flow rate. Other outer head configurations, as shown in other embodiments, are possible for various head movement/flow rate relationships.

As can be seen, axial movement of the solenoid core 179 in the upward direction is produced by energization of the upper coil 176 and lower coil 177 with one polarity of pulse while axial movement of the core 179 in the downward direction is produced by the flow of current through the coils 176 and 177 in the opposite direction. Axial movement of the core 179 produces axial movement of the core nipple 176 which moves the cam sleeve 182 in the vertical direction. Axial movement of the cam sleeve 182 produces rotational movement of the stem 196 as a result of camming action of the slots 204 and 214 against the dowel pins 200 and 213 as explained above. This rotational movement of the dowel pins 200 and 213 rotates the stem 196 to produce rotary movement of the threads 152. Rotation of the threads 152 moves the poppet valve shaft 154 in the axial direction to change the size of the orifice of the poppet valve. Rotational movement of the stem 196 also rotates the indicator rod 164 to change the position of the indicator 163 and indicate through the downhole electronics 152D the position of the rotational shaft and thereby correlate it with the size of the effective flow orifice between the poppet head 142 and the seat 144. The rotational position information is transmitted to the surface controller 30 by means of the control line 47.

Thus, it can be seen how sequential incremental movements of the solenoid core 179 produces incremental rotational movements of the stem 196 which in turn either opens or closes the poppet valve formed by the poppet head 142 and the valve seat 144 in corresponding incremental movements. The interruption of flow through the coils 176 and 177 allows the core 179 to remain in the neutral position. Therefore, the size of the flow orifice of the poppet valve remains in a position stable configuration until additional current pulses flow through the solenoid coils.

Figure 3E:
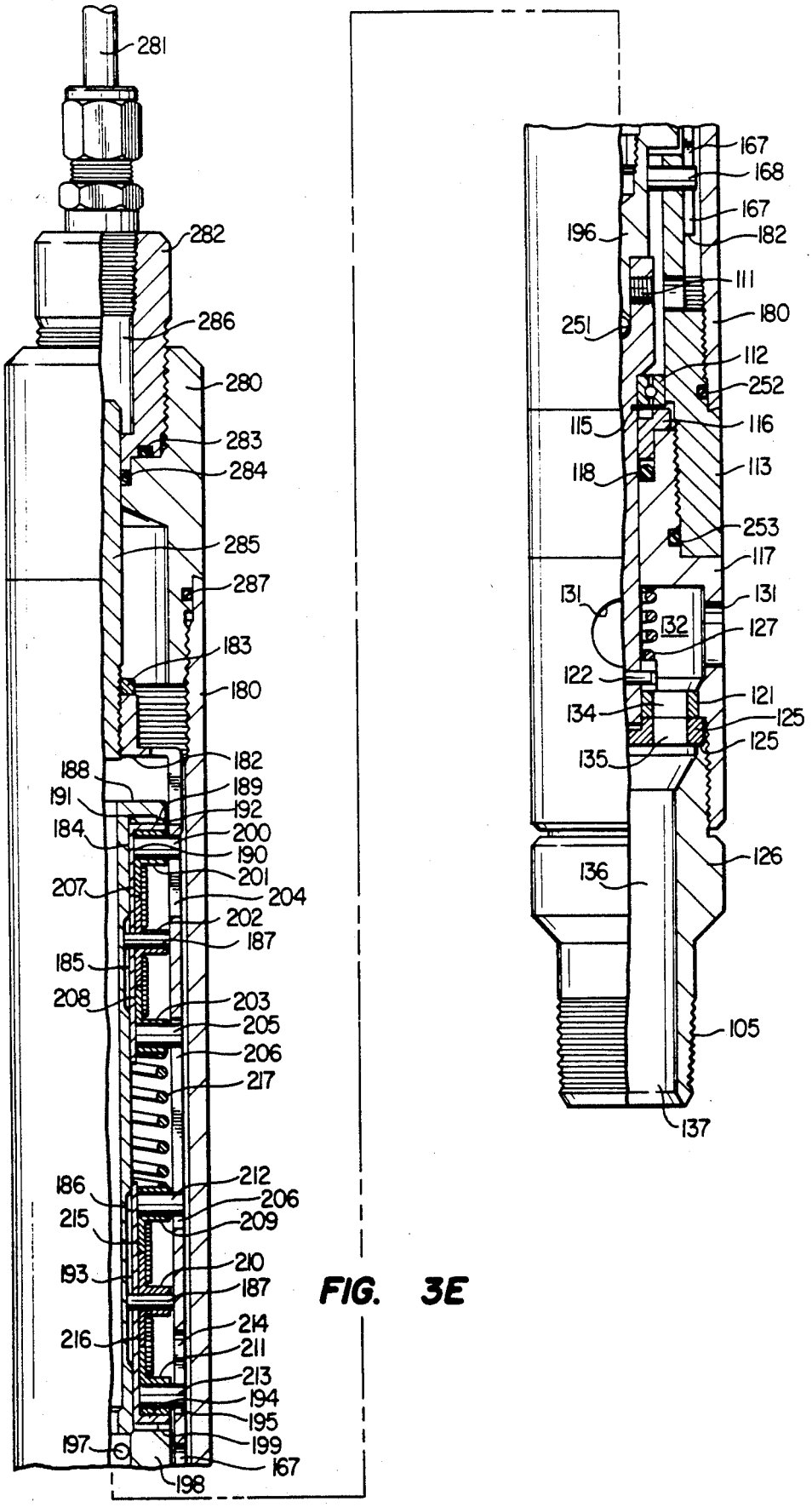
FIG. 3E is a partially cut-away and cross-sectioned view of a flow control valve including a pressure pulse actuated plunger operated rotary valve constructed in accordance with a fifth embodiment of the present invention.

Referring next to FIG. 3E, there is shown a fifth embodiment of the flow control valve of the present invention. As shown in FIG. 3E, there is a pressure pulse operated valve piston coupled with a rotary valve system. The valve 280 includes a port bushing 282 into which a pressurized control line 281 is connected by conventional fittings. The port bushing 282 is in threaded engagement with the valve body 280 and sealed thereto by means of 0-rings 283 and 284. A plunger 285 operates for movement in the axial direction as a function of the pressure within the operating chamber 286. A positive pressure pulse will move the plunger 285 down from its central position while a negative pressure pulse will pull the plunger 285 up from its central position. The lower end of the plunger 285 is coupled to the upper end of a cam sleeve 82. A stem extension 184 is enclosed within the cam sleeve 184 and includes a pair of axially spaced, circumferentially extending recesses 185 and 186 which receive and allow movement of a pair of dowel pins 187.

The upper end of the stem extension 184 has a circular radially extending flange 188 which includes a downwardly facing outer edge portion 189 with radially extending teeth formed thereon. An upper clutch sleeve 190 includes an elongate tubular shaft which is journaled upon the stem extension 184 for relative movement in both circumferential directions. The upper end of the upper clutch sleeve 190 includes a circular radially extending flange 191 which has an upwardly facing outer edge portion 192 with radially extending teeth thereon. When the radial teeth in the downwardly facing edge portion 189 of the stem extension flange edge 188 engage the radial teeth in the upwardly facing edge portion 192 of the upper clutch sleeve flange 191 the two parts move together as a unit in the circumferential direction. As in other embodiments, the teeth are preferably angled. When the two sets of radial teeth are spaced from one another the upper clutch sleeve 190 moves freely about the stem extension shaft in both circumferential directions.

An identical lower clutch sleeve 193 has an elongate tubular shaft which is journaled upon the lower portion of the stem extension 184 for relative movement in both circumferential directions. The lower end of the lower clutch sleeve 193 includes a circular radially extending flange 194 which has a downwardly facing outer edge portion 195 with radially extending teeth thereon. The lower end of the stem extension is threadedly coupled to the upper end of a stem 196 and held in secure engagement therewith by a set screw 197. The lower end of the cam sleeve 182 overlies most of the stem 196 and includes a longitudinal slot 167 which is open at the lower end to receive the dowel pin 168. The upper end of the stem 196 has a circular radially extending shoulder 198 which includes an upwardly facing outer edge portion 199 with radially extending teeth. When the radial teeth of the upwardly facing edge portion 199 of the stem shoulder 198 engage the radial teeth in the downwardly facing edge portion 195 of the lower clutch sleeve flange 194 the two parts, along with the stem extension 184, move together in the circumferential direction. When the two sets of radial teeth are spaced from one another, the lower clutch sleeves 193 moves freely about the stem extension shaft in both circumferential directions.

Overlying and journaled upon the outer surface of the tubular shaft of the upper clutch sleeve 190 are an upper end drum 201, a center drum 202 and a lower end drum 203. The upper end drum 201 includes a dowel pin 200 which is received into an upper longitudinally extending slot 204 in the cam sleeve 182. The center drum 202 includes a dowel pin 187 which extends through an aperture in the upper clutch sleeve 190 to rigidly connect it therewith and into the upper recess 185 in the stem extension 184. The lower end drum 203 includes a dowel pin 205 which is received into a central longitudinally extending slot 206 in the cam sleeve 182. A helical clutch spring with left hand windings 207 overlies and engages the cylindrical outer surfaces of both the upper end drum 201 and the upper portion of the center drum 202. A similar helical clutch spring with right hand windings 208 overlies and engages the cylindrical outer surfaces of both the lower end drum 203 and the lower portion of the center drum 202.

Overlying and journaled upon the outer surface of the tubular shaft of the lower clutch sleeve 193 are an upper end drum 209, a center drum 210 and a lower end drum 211. The upper end drum 109 includes a dowel pin 212 which is received into the central longitudinally extending slot 206 in the cam sleeve 182. The center drum 210 includes a dowel pin 187 which extends through an aperture in the lower clutch sleeve 193 to rigidly connect it therewith and into the lower recess 186 in the stem extension 184. The lower end drum 203 includes a dowel pin 213 which is received into a lower longitudinally extending slot 214 in the cam sleeve 182. A helical clutch spring with left hand windings 215 overlies and engages the cylindrical outer surfaces of both the upper end drum 209 and the upper portion of the center drum 210. A similar helical clutch spring with a right hand winding 216 overlies and engages the cylindrical outer surfaces of the lower end drum 211 and the lower portion of the center drum 210.

A helical coil spring 217 is compressed between the radially extending flanged end of the lower end drum 203 and the radially extending flanged end of the upper end drum 209. The biasing force of spring 217 holds the dowel pin 200 in the upper end of slot 204 and the teeth on the upper surface of the outer edge portion 192 of upper clutch sleeve 190 in driving engagement with the teeth on the lower surface of the outer edge portion 189 of stem extension 184. Similarly, the biasing force of spring 217 holds the dowel pin 213 in the lower end of slot 214 and the teeth in the lower surface of the outer edge portion 195 of the lower clutch sleeve 193 in driving engagement with the teeth on the upper surface of the outer edge portion 199 of the stem 196. Downward movement of dowel pin 200 will disengage the upper sets of teeth on edge portions 192 and 189 while leaving the lower sets of teeth on edge portions 195 and 199 in driving engagement with one another. Similarly, upward movement of dowel pin 213 will disengage the lower sets of teeth on edge portions 195 and 199 while leaving the upper sets of teeth on edge portions 192 and 189 in driving engagement with one another.

Referring briefly to FIG. 7, there can be seen how the cam sleeve 182 overlies and encloses the spring and clutch mechanisms described above. The upper slot 204 in the cam sleeve 182 which receives the dowel pin 200 is angled downwardly and to the left while the lower slot 214 in the cam sleeve 182 which receives dowel pin 213 is angled upwardly and to the right. The central slot 206 in the cam sleeve 182 which receives dowel pins 205 and 212 extends parallel to the longitudinal axis of the sleeve 182. As can be seen from FIG. 7, the incremental distance in the circumferential direction by which the upper and lower ends of the lower slot 214 are separated from one another is slightly greater than the incremental distance in the circumferential direction by which the upper and lower ends of the upper slot 204 are separated from one another. As discussed above, this feature along with the alternative feature of adjusting the stroke of the cam sleeve may enable selection of the size of the valve flow orifice in very small increments of value as will be further explained below.

Movement of the cam sleeve 82 upwardly, in the direction of arrow 220, causes the dowel pin 200 to follow the slot 204 and move circumferentially in the clockwise direction, looking down. Such movement of the cam sleeve 182 moves the dowel pin 213 upwardly which lifts dowel pin 187 and the lower clutch sleeve 193 to disengage the lower sets of teeth on edge portions 195 and 199 to allow stem extension 184 to rotate with respect to the lower clutch sleeve 193. Upward movement of the cam sleeve 182 also moves the dowel pin 212 upwardly to maintain the compression on the spring 217 which holds the upper sets of teeth on edge portions 189 and 192 in driving engagement with one another. Circumferential movement of the dowel pin 200 in the clockwise direction the incremental distance by which the upper and lower ends of slot 204 are circumferentially displaced from one another, also rotates the upper end drum 201 through the same incremental distance. Rotation of the upper end drum 201 causes the left hand wound spring 207 to grip the center drum 202 and rotate it which moves dowel pin 187 and the upper clutch sleeve 190. The right hand wound spring 208 slips to prevent rotation of the center drum 202 from rotating the lower end drum 203. The driving engagement between the teeth on edge portion 192 of upper clutch sleeve 190 and edge portion 189 of the stem extension 184 produces an incremental rotation of the stem extension 184 and the stem 196 to which it is coupled. Rotation of the stem 196 rotates the drive shaft 109 and the upper valve plate 121 and changes the effective flow orifice of the valve an incremental amount.

Return downward movement of the cam sleeve 182 to its neutral position, shown in FIG. 7, is produced by the bias of spring 217 and causes downward movement of the dowel pin 213 which reconnects the driving engagement between the lower clutch sleeve 194 and the stem 196. Return downward movement of cam sleeve 182 also causes dowel pin 200 to follow the upper slot 204 and move circumferentially an incremental distance in the counter clockwise direction, looking down. Such movement of pin 200 rotates the upper end drum 201 but, because of slippage of the left hand spring 207 the center drum 202 does not rotate and the upper clutch sleeve 190 does not rotate so that the stem extension 184, the stem 196, the rotary shaft 109 and the upper valve plate 121 remain where they were and the flow control orifice is not changed.

Similarly, movement of the cam sleeve downwardly, in the direction of arrow 221, causes the dowel pin 213 to follow the slot 214 and move circumferentially in the counter-clockwise direction, looking down. Such movement of the cam sleeve 182 moves the dowel pin 200 downwardly which pulls dowel pin 187 and the upper clutch sleeve 190 downwardly to disengage the upper sets of teeth on edge portions 189 and 192 to allow stem extension 184 to rotate with respect to the upper clutch sleeve 191. Downward movement of the cam sleeve 182 also moves the dowel pin 205 downwardly to maintain the compression on the spring 217 which holds the lower set of teeth on edge portions 195 and 199 in driving engagement with one another. Circumferential movement of the dowel pin 213 in the counter-clockwise direction incremental distance by which the upper and lower ends of slot 214 are circumferentially displaced from one another, also rotates the lower end drum 211 through the same incremental distance. Rotation of the lower end drum 211 causes the right hand wound spring 216 to grip the center drum 210 and rotate it which moves dowel pin 187 and lower clutch sleeve 194. The driving engagement between the teeth on edge portions 195 on lower clutch sleeves 194 and edge portion 199 of the stem 196 produces an incremental rotation of the stem 196. Rotation of the stem 196 rotates the drive shaft 109 and the upper valve plate 121 and changes the effective flow orifice of the valve an incremental amount.

Return upward movement of the cam sleeve 182 to its neutral position, shown in FIG. 7, is produced by the bias of spring 217 and causes upward movement of dowel pin 200 to reconnect the driving engagement between the upper clutch sleeve 191 and the stem extension 184. Return upward movement of cam sleeve 182 also causes dowel pin 213 to follow the lower slot 214 and move circumferentially an incremental distance in the clockwise direction, looking down. Such movement of pin 213 rotates the lower end drum 211 but, because of slippage of the right hand spring 215 the center drum 210 does not rotate and the lower clutch sleeve 194 does not rotate so that the stem 196, the rotary shaft 109 and the upper valve plate 121 remain where they were and the flow control orifice is not changed.

It should be noted that the incremental distance in the circumferential direction by which the stem 196 moves in the counter-clockwise direction, looking down, in response to an upward movement of the cam sleeve 182 will be slightly greater than the incremental distance in the circumferential direction by which the stem 196 moves in the clockwise direction in response to a downward movement of the cam sleeve. This is because of the slight difference in slant angle between slots 204 and 214 from the axis of the cam sleeve 192. This angular difference enables effective incremental movements of a rotary drive shaft 109 which are as small as the difference between the two circumferential movements in the opposite directions. Selective adjustment is accomplished by one or more movements in one direction followed by a selected number of movements in the opposite direction. The effective movement of the drive shaft is the difference between sum of the incremental movements in each direction.

The lower end of the stem 196 is mounted into the socket end 251 of a rotary drive shaft 109. The ratchet housing 180 is threadedly engaged to a bearing housing 113 and sealed thereto by means of an 0-ring 252. The rotary drive shaft 109 is mounted to a ball bearing 112 which is held in position by bushing 116 and a retainer ring 115. The bushing 116 is mounted at the upper end of a rotary port sub 117 which is threadedly engaging the lower end of the bearing housing 113 and sealed thereto by means of a 0-ring 253.

The lower end of the rotary drive shaft 109 is rigidly affixed to a rotary valve plate 121 by means of a spiral pin 122. A helical coil valve spring 127 biases the upper edge of the rotary valve plate 121 into shear sealing engagement with the stationary valve plate 123. A plurality of orthogonally disposed flow intake ports 131 are formed in the sidewalls of the rotary port sub 117 and are in fluid communication with a chamber 132 which overlies the rotary valve plate 121. Alignment of the flow control ports 134 in the rotary valve plate 121 with the flow control ports 135 in the stationary valve plate 123 allow fluid flow through the flow intake port 131, the chamber 132 and through the internal passageway 136 leading to the exit opening 137 at the lower end of the valve. The exit 137 opening is located at the lower end of a bottom sub 126 which is threaded at 105 to allow engagement with other couplings.

As can be seen, the application of intermittent pressure pulses into the chamber 286 by means of a pressurized fluid, such as a gas, flowing through the conduit 281 produces vertical movement of the plunger 225 and therefore vertical movement of the cam sleeve 182. Vertical movement of the cam sleeve 182. As explained above, causes rotational movement Of the dowel pins 200 and 213 because of the camming action of slots 204 and 214 in cam sleeve 182 thereby producing rotational movement of the rotary drive 109. Rotation of the rotary drive 109 produces a rotational movement of the rotary valve plate 121 with respect to the stationary valve plate 123. This changes the alignment between the ports 134 in the rotary valve plate 121 and the ports 135 and the stationary valve plate 123, and therefore, the degree of fluid flow which is allowed through the valve orifice. In the fifth embodiment, shown in FIG. 3E, there is no absolute position indicator for the valve shown, although one could be provided to monitor the rotational position of the drive shaft 109 or the stem extension 184. However, each negative pressure pulse through the conduit 281 produces movement of the plunger 285 from a centered position in the upward direction which produces rotational movement of the rotary valve plate 121 in one direction while each positive pressure pulse produces movement of the plunger 285 in the downward direction which produces rotation of the rotary valve plate 121 in the opposite direction. The number of successive pressure pulses and their polarity could be monitored and a representation thereof stored in a register in the surface controller 30 to provide a continuous indication of valve position with respect to a calibration reference point.

If gas is used as the pulse transmission medium, fluid density will not be a hinderance, however, the use of gas greatly slow the operation of the valve. It should also be understood that two control lines and a double acting piston could be used so the actuator would not be depth sensitive and the operation would be faster.

Figure 3F:
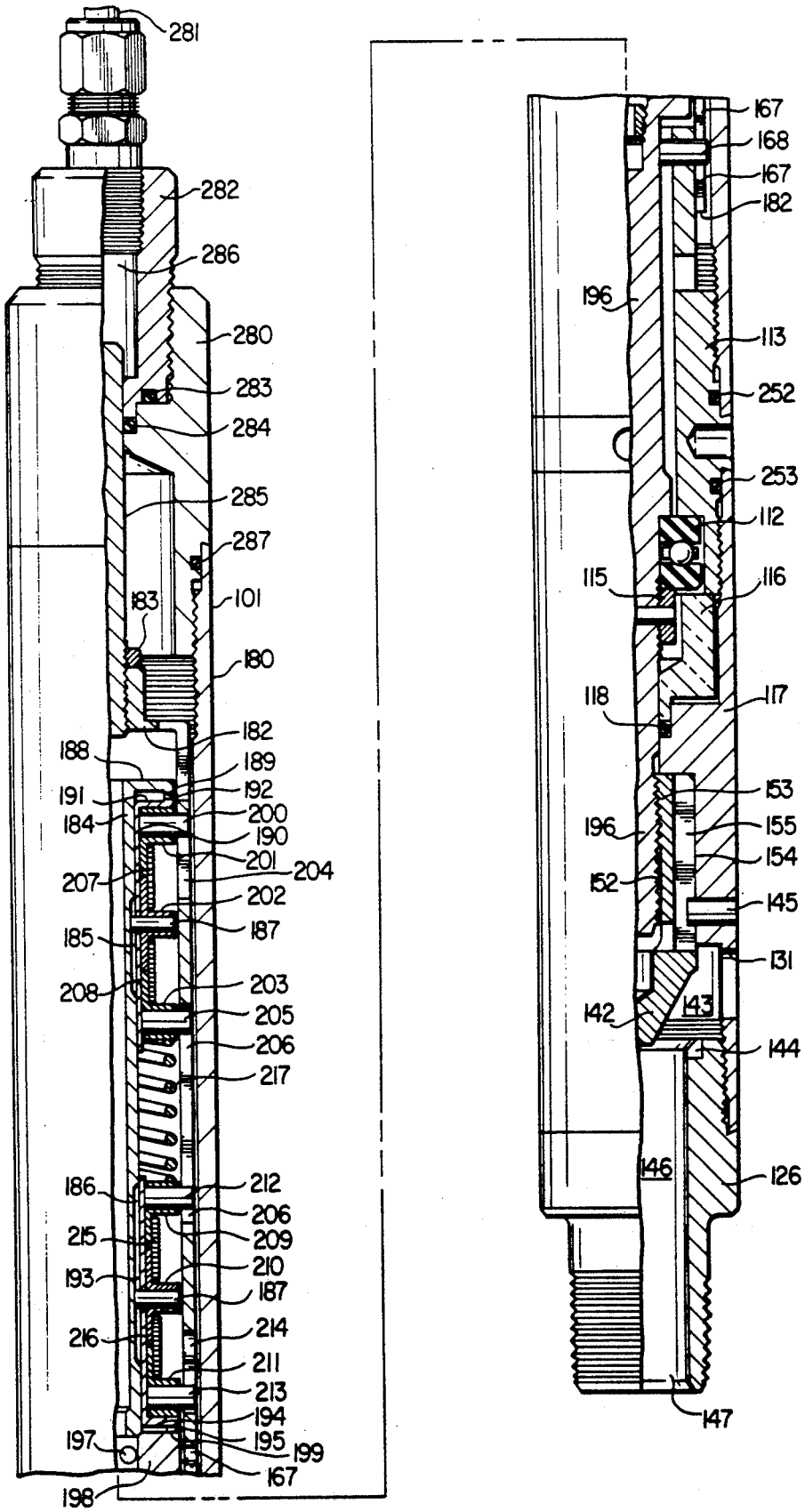
FIG. 3F is a partially out-away and cross-sectioned view of a flow control valve including a pressure pulse actuated plunger operated poppet valve constructed in accordance with a sixth embodiment of the present invention.

Referring now to FIG. 3F, there is shown a sixth embodiment of the flow control valve of the present invention which includes a pressure pulse actuator and a non-rising stem poppet type valve flow control mechanism. Referring to FIG. 3F, the valve 280 includes a port bushing 282 into which is coupled a pressure pulse line 281. The bushing 282 is sealed to the valve body by means of 0-rings 283 and 284. A plunger 285 is mounted for axial movement within the valve body in response to the pressure in a chamber 286 produced as a result of the pressure within the pressure pulse line 281. The lower end of the plunger 285 is rigidly coupled to a cam sleeve 182 by means of a lock nut 183. A stem extension 184 is enclosed within the cam sleeve 184 and includes a pair of axially spaced, circumferentially extending recesses 185 and 186 which receive and allow movement of a pair of dowel pins 187.

The upper end of the stem extension 184 has a circular radially extending flange 188 which includes a downwardly facing outer edge portion 189 with radially extending teeth formed thereon. An upper clutch sleeve 190 includes an elongate tubular shaft which is journaled upon the stem extension 184 for relative movement in both circumferential directions. The upper end of the upper clutch sleeve 190 includes a circular radially extending flange 191 which has an upwardly facing outer edge portion 192 with radially extending teeth thereon. When the radial teeth in the downwardly facing edge portion 189 of the stem extension flange edge 188 engage the radial teeth in the upwardly facing edge portion 192 of the upper clutch sleeve flange 191 the two parts move together as a unit in the circumferential direction. As mentioned above in connection with the other embodiments of the linear motion to rotary motion converter used in the valves of the invention, the teeth in the various clutch plates may be ,angled to prevent disengagement due to camming action by the slots in the cam sleeve against the pins. When the two sets of radial teeth are spaced from one another the upper clutch sleeve 190 moves freely about the stem extension shaft in both circumferential directions.

An identical lower clutch sleeve 193 has an elongate tubular shaft which is journaled upon the lower portion of the stem extension 184 for relative movement in both circumferential directions. The lower end of the lower clutch sleeve 193 includes a circular radially extending flange 194 which has a downwardly facing outer edge portion 195 with radially extending teeth thereon. The lower end of the stem extension is threadedly coupled to the upper end of a stem 196 and held in secure engagement therewith by a set screw 197. The lower end of the cam sleeve 182 overlies most of the stem 196 and includes a longitudinal slot 167 which is open at the lower end to receive the dowel pin 168. The upper end Of the stem 196 has a circular radially extending shoulder 198 which includes an upwardly facing outer edge portion 199 with radially extending teeth. When the radial teeth of the upwardly facing edge portion 199 of the stem shoulder 198 engage the radial teeth in the downwardly facing edge portion 195 of the lower clutch sleeve flange 194 the two parts, along with the stem extension 184, move together in the circumferential direction. When the two sets of radial teeth are spaced from one another, the lower clutch sleeves 193 moves freely about the stem extension shaft in both circumferential directions.

Overlying and journaled upon the outer surface of the tubular shaft of the upper clutch sleeve 190 are an upper end drum 201, a center drum 202 and a lower end drum 203. The upper end drum 201 includes a dowel pin 200 which is received into an upper longitudinally extending slot 204 in the cam sleeve 182. The center drum 202 includes a dowel pin 187 which extends through an aperture in the upper clutch sleeve 190 to rigidly connect it therewith and into the upper recess 185 in the stem extension 184. The lower end drum 203 includes a dowel pin 205 which is received into a central longitudinally extending slot 206 in the cam sleeve 182. A helical clutch spring with left hand windings 207 overlies and engages the cylindrical outer surfaces of both the upper end drum 201 and the upper portion of the center drum 202. A similar helical clutch spring with right hand windings 208 overlies and engages the cylindrical outer surfaces of both the lower end drum 203 and the lower portion of the center drum 202.

Overlying and journaled upon the outer surface of the tubular shaft of the lower clutch sleeve 193 are an upper end drum 209, a center drum 210 and a lower end drum 211. The upper end drum 109 includes a dowel pin 212 which is received into the central longitudinally extending slot 206 in the cam sleeve 182. The center drum 210 includes a dowel pin 187 which extends through an aperture in the lower clutch sleeve 193 to rigidly connect it therewith and into the lower recess 186 in the stem extension 184. The lower end drum 203 includes a dowel pin 213 which is received into a lower longitudinally extending slot 214 in the cam sleeve 182. A helical clutch spring with left hand windings 215 overlies and engages the cylindrical outer surfaces of both the upper end drum 209 and the upper portion of the center drum 210. A similar helical clutch spring with a right hand winding 216 overlies and engages the cylindrical outer surfaces of the lower end drum 211 and the lower portion of the center drum 210.

A helical coil spring 217 is compressed between the radially extending flanged end of the lower end drum 203 and the radially extending flanged end of the upper end drum 209. The biasing force of spring 217 holds the dowel pin 200 in the upper end of slot 204 and the teeth on the upper surface of the outer edge portion 192 of upper clutch sleeve 190 in driving engagement with the teeth on the lower surface of the outer edge portion 189 of stem extension 184. Similarly, the biasing force of spring 217 holds the dowel pin 213 in the lower end of slot 214 and the teeth in the lower surface of the outer edge portion 195 of the lower clutch sleeve 193 in driving engagement with the teeth on the upper surface of the outer edge portion 199 of the stem 196. Downward movement of dowel pin 200 will disengage the upper sets of teeth on edge portions 192 and 189 while leaving the lower sets of teeth on edge portions 195 and 199 in driving engagement with one another. Similarly, upward movement of dowel pin 213 will disengage the lower sets of teeth on edge portions 195 and 199 while leaving the upper sets of teeth on edge portions 192 and 189 in driving engagement with one another.

Referring briefly to FIG. 7, there can be seen how the cam sleeve 182 overlies and encloses the spring and clutch mechanisms described above. The upper slot 204 in the cam sleeve 182 which receives the dowel pin 200 is angled downwardly and to the left while the lower slot 214 in the cam sleeve 182 which receives dowel pin 213 is angled upwardly and to the right. The central slot 206 in the cam sleeve 182 which receives dowel pins 205 and 212 extends parallel to the longitudinal axis of the sleeve 182. As can be seen from FIG. 7, the incremental distance in the circumferential direction by which the upper and lower ends of the lower slot 214 are separated from one another is slightly greater than the incremental distance in the circumferential direction by which the upper and lower ends of the upper slot 204 are separated from one another. This feature, along with the alternative feature described above, enables selection of the size of the valve flow orifice in very small increments of value as will be further explained below.

Movement of the cam sleeve 182 upwardly, in the direction of arrow 220, causes the dowel pin 200 to follow the slot 204 and move circumferentially in the clockwise direction, looking down. Such movement of the cam sleeve 182 moves the dowel pin 213 upwardly which lifts dowel pin 87 and the lower clutch sleeve 193 to disengage the lower sets of teeth on edge portions 195 and 199 to allow stem extension 184 to rotate with respect to the lower clutch sleeve 193. Upward movement of the cam sleeve 182 also moves the dowel pin 212 upwardly to maintain the compression on the spring 217 which holds the upper sets of teeth on edge portions 189 and 192 in driving engagement with one another. Circumferential movement of the dowel pin 200 in the clockwise direction the incremental distance by which the upper and lower ends of slot 204 are circumferentially displaced from one another, also rotates the upper end drum 201 through the same incremental distance. Rotation of the upper end drum 201 causes the left hand wound spring 207 to grip the center drum 202 and rotate it which moves dowel pin 187 and the upper clutch sleeve 190. The right hand wound spring 208 slips to prevent rotation of the center drum 202 from rotating the lower end drum 203. The driving engagement between the teeth on edge portion 192 of upper clutch sleeve 190 and edge portion 189 of the stem extension 184 produces an incremental rotation of the stem extension 184 and the stem 196 to which it is coupled. Rotation of the stem 196 rotates the drive shaft 109 and the upper valve plate 121 and changes the effective flow orifice of the valve an incremental amount.

Return downward movement of the cam sleeve 182 to its neutral position, shown in FIG. 7, is produced by the bias of spring 217 and causes downward movement of the dowel pin 213 which reconnects the driving engagement between the lower clutch sleeve 194 and the stem 196. Return downward movement of cam sleeve 182 also causes dowel pin 200 to follow the upper slot 204 and move circumferentially an incremental distance in the counter clockwise direction, looking down. Such movement of pin 200 rotates the upper end drum 201 but, because of slippage of the left hand spring 207 the center drum 202 does not rotate and the upper clutch sleeve 190 does not rotate so that the stem extension 184, the stem 196, the rotary shaft 109 and the upper valve plate 121 remain where they were so that the flow control orifice is not changed.

Similarly, movement of the cam sleeve downwardly, in the direction of arrow 221, causes the dowel pin 213 to follow the slot 214 and move circumferentially in the counter-clockwise direction, looking down. Such movement of the cam sleeve 182 moves the dowel pin 200 downwardly which pulls dowel pin 187 and the upper clutch sleeve 190 downwardly to disengage the upper sets of teeth on edge portions 189 and 192 to allow stem extension 184 to rotate with respect to the upper clutch sleeve 191. Downward movement of the cam sleeve 182 also moves the dowel pin 205 downwardly to maintain the compression on the spring 217 which holds the lower set of teeth on edge portions 195 and 199 in driving engagement with one another. Circumferential movement of the dowel pin 213 in the counter-clockwise direction incremental distance by which the upper and lower ends of slot 214 are circumferentially displaced from one another, also rotates the lower end drum 211 through the same incremental distance. Rotation of the lower end drum 211 causes the right hand wound spring 216 to grip the center drum 210 and rotate it which moves dowel pin 187 and lower clutch sleeve 194. The driving engagement between the teeth on edge portions 195 on lower clutch sleeves 194 and edge portion 199 of the stem 196 produces an incremental rotation of the stem 196. Rotation of the stem 196 rotates the drive shaft 109 and the upper valve plate 121 and changes the effective flow orifice of the valve an incremental amount.

Return upward movement of the cam sleeve 182 to its neutral position, shown in FIG. 7, is produced by the bias of spring 217 and causes upward movement of dowel pin 200 to reconnect the driving engagement between the upper clutch sleeve 191 and the stem extension 184. Return upward movement of cam sleeve 182 also causes dowel pin 213 to follow the lower slot 214 and move circumferentially an incremental distance in the clockwise direction, looking down. Such movement of pin 213 rotates the lower end drum 211 but, because of slippage of the right hand spring 215 the center drum 210 does not rotate and the lower clutch sleeve 194 does not rotate so that the stem 196, the rotary shaft 109 and the upper valve plate 121 remain where they were and the flow control orifice is not changed.

It should be noted that the incremental distance in the circumferential direction by which the stem 196 moves in the counter-clockwise direction, looking down, in response to an upward movement of the cam sleeve 182 will be slightly greater than the incremental distance in the circumferential direction by which the stem 196 moves in the clockwise direction in response to a downward movement of the cam sleeve. This is because of the slight different in slant angle between slots 204 and 214 from the axis Of the cam sleeve 192. This angular difference enables effective incremental movements of a rotary drive shaft 109 which are as small as the difference between the two circumferential movements in the opposite directions. Selective adjustment is accomplished by one or more movements in one direction followed by a selected number of movements in the opposite direction. The effective movement of the drive shaft is the difference between sum of the incremental movements in each direction.

The lower end of the stem 196 is mounted for rotational movement by means of a ball bearing 112 held in position within a bearing housing 113 by means of a bushing 116 and a retainer ring 115. The bearing housing 113 is threadedly coupled to the ratchet housing 180 and sealed thereto by means of an 0-ring 252. The lower end of the bearing housing 113 is threadedly coupled to a rotary port sub 117 and sealed thereto by means of a 0-ring 253. The lower end of the stem 196 includes external threads 152 which engage the internal drive threads 153 of a non-rising poppet valve shaft 154. A vertically extending slot 155 in the valve shaft 154 is in sliding engagement with a spiral pin 145 extending through the sidewall of the rotary port sub 117 to prevent rotational movement of the poppet valve shaft 154. The lower end of the valve shaft 154 is attached to a poppet head 142 which is spaced from a poppet seal 144. The seal 144 is mounted on the upper end of a bottom sub 126.

A plurality of orthogonally arranged flow intake ports 13 are formed in the sidewall of the rotary port sub 117 and are in flow communication with a chamber 143 which is coupled to an axially extending flow passageway 146 leading to an opening 147 in the lower end of the valve body. As can be seen, rotation of the drive shaft 152 causes rotational movement of the valve shaft 154 moving the poppet head 142 either toward or away from the valve seat 144, thereby opening or closing the flow control orifice between the flow intake port 131 and the flow outtake port 147. Axial movement of the plunger 125 produced by the pressure within the chamber 226 causes vertical reciprocating movement of the cam sleeve 182 causes a camming action by the slots 204 and 214 against the dowel pins 200 and 213, as described above to produce rotational movement of the stem 196 causing a change in the size of the effective orifice in the valve.

As can be seen, the intermittent movement of the plunger in 285 in one direction produces rotational movement of the stem 196 in one direction and hence either opens the valve or closes the valve. Intermittent movement of the plunger 285 in the opposite direction produces rotational movement of the stem 196 in the opposite direction which causes the opposite effect on the valve poppet head in its control over the flow of fluid through the valve orifice.

As can be seen from the above six embodiments of the system of the present flow control valve, there are two basic configurations of flow control mechanisms. One is a poppet type valve and the other is a rotary type valve.

Figure 4:
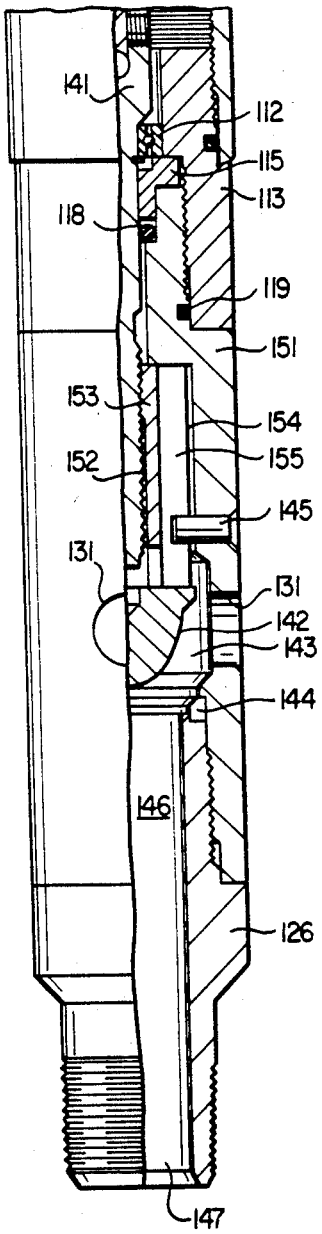
FIG. 4 is a partially out-away and cross-sectioned view of one end of a flow control valve including a rotary actuated nonrising stem poppet valve.

Referring now to FIG. 4, there is shown in more detail a configuration of the non-rising stem poppet type valve and its manner of operation as a function of the rotation of the rotary drive shaft which controls the movement of the valve.

In FIG. 4, there is shown a partially cross-sectioned view illustrating the construction of the poppet valve actuator used in the flow control valve of the present invention. A rotary drive shaft 141 is journaled within a ball bearing 112 positioned within a bearing housing 113. The bearing 112 is positioned by means of a retainer ring 115 above a bushing 116 which is held in position by the upper end of a port sub 151 which is threadedly engaged with the bearing sub 113 and sealed thereto by means of an 0-ring 119. An 0-ring 118 provides a further seal along the shaft of the rotary drive 141. The lower end of the rotary drive 141 includes external helical threads 152 which engage the internal helical threads 153 of an axial bore formed within a poppet valve shaft 154. The lower end of the poppet valve shaft 154 has attached thereto a poppet valve head 142 and a longitudinally extending slot 155 running the length thereof. The slot 155 is engaged by means of a spiral pin 145 which extends through an aperture in the outer wall of the port sub 151. The spiral pin 145 in engagement with the longitudinal slot 155 prevents the valve shaft 153 from rotating and only allows movement of the shaft 154 in the axial direction.

The outer wall of the port sub 151 includes a plurality of orthogonally disposed flow intake ports 131 which open into an internal valve cavity 143 which overlies a poppet valve seat 144 positioned at the upper end of a bottom sub 126. The bottom sub 126 is in threaded engagement with the lower end of the port sub 151. The outer surface of the poppet head 142 is configured for engagement with the circular poppet seat 144 to provide a sealing action there between to prevent flow from the chamber 143 into an axial passageway 146 extending the length of the bottom sub to the opening 147 at the lower end thereof. When the poppet head 142 is spaced from the poppet seat 144, fluid flow is permitted from the outside of the valve through the flow intake ports 131, the flow chamber 143, the axial passageway 146 and out the opening 147 in the lower end of the bottom sub 126. As can be seen, rotation of the drive shaft 141 rotates the external threads 152 on the lower end thereof. The threaded rotating engagement with the internal threads 153 in the valve shaft 154 causes axial movement of the valve shaft and therefore movement of the poppet valve head 142 toward and away from the poppet seat 144 depending upon the direction of rotation of the shaft. In either case, the degree of flow allowed through the effective valve orifice between the poppet head 142 and the poppet seat 144 is a direct function of the distance therebetween and therefore the rotational position of the drive shaft 141.

As can also be seen from FIG. 4, the position of the flow orifice between the poppet head 143 and the poppet seat 144 is position stable. That is, when the drive-shaft 141 is held in a fixed rotational position, the flow orifice of the valve is not changed. Finally, it can be seen from FIG. 4 that the rotational position of the drive shaft 141, from some preselected reference point, can be directly correlated with the degree of flow opening which is allowed through the valve. In this way, the degree of opening can be constantly monitored by means of monitoring the rotational position of the drive shaft 141.

Figure 5:
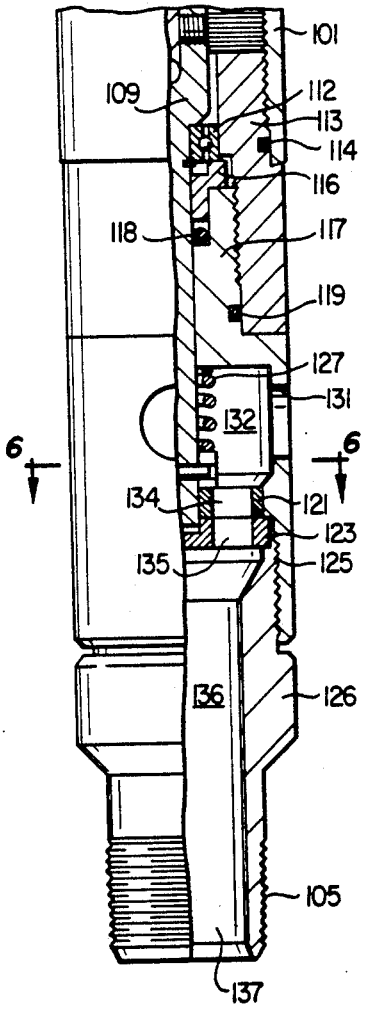
FIG. 5 is a partially out-away and cross-sectioned view of a rotary, lapped, shear seal valve.

Referring now to FIG. 5, there is shown an enlarged view of the rotary flow control valve portions which are used in the flow control valve of the present invention. As shown, a rotary drive shaft 109 is also mounted within a ball bearing 112 which is positioned within a bearing housing 113 by means of a retainer ring 115 and bushing 116. The bushing 116 is held in position at the upper end of a port sub 117 which is threadedly engaged with the lower end of the bearing sub 113 and sealed thereto by means of an 0-ring 119. An 0-ring 118 provides an additional sealing means between the bushing 116 and the rotary shaft 109. The upper end of the bearing housing 113 is sealed to the outer housing of the valve 101 by means of threaded engagement and an 0-ring 114.

The lower end of the rotary drive shaft 109 is attached to an upper rotary valve plate 121 which overlies a stationary valve plate 123. The rotary valve plate 121 is fixed to the end of the shaft 109 by means of a spiral pin 122. The rotary valve plate 121 is pressed into shear sealing engagement with the upper surface of the stationary valve plate 123 by means of a helical valve spring 127 to prevent leakage between the respectively moving parts. The port sub 177 includes a plurality of orthogonally positioned flow intake ports 131 which are in fluid communication with a valve chamber 132. The rotary valve plate 121 includes a plurality of flow ports 134 while the stationary valve plate 123 includes a plurality of flow ports 135 which can be rotationally positioned to be in either more or less alignment with one another to control the flow therethrough. Flow from outside the valve body passes through the flow intake port 13 into the valve chamber 132 and through the aligned ports 134 and 135 into a longitudinal flow channel 136 through the bottom sub 126 and out the opening 137 in the bottom of the valve. As can be seen from FIG. 5, the rotational position of the rotary drive shaft 109 controls the degree of alignment of the ports 134 in the rotary valve plate 135 with the ports 135 in the stationary valve plate 123 to thereby control the degree of flow permitted from the flow intake ports 131 to the opening 137 in the bottom sub 126. As can also be seen, the position of the flow control valve, formed by the rotary plate 121 and the stationary plate 125 and the flow ports 134 and 135 therein, are position stable. That is, when the drive shaft 109 is stationary, the degree of alignment between the ports 134 and 135 is stable and hence the flow permitted therethrough is constant. Rotation of the drive shaft 109 in one direction increases the degree of alignment between the ports 134 and 135 and rotation of the drive shaft 109 in the opposite direction decreases the degree of alignment between the ports 134 and 135. The rotational position of the drive shaft 109 may also be directly correlated to the degree of alignment of the ports 134 and 135 and hence the amount of flow which is permitted through the effective orifice of the valve. Thus, monitoring the rotational position of the drive shaft 109 gives an indication of the degree of opening through the effective orifice of the valve and enables monitoring of the size of that orifice at the surface as a function of the position of angular rotation of the drive shaft 109.

Figure 6A:
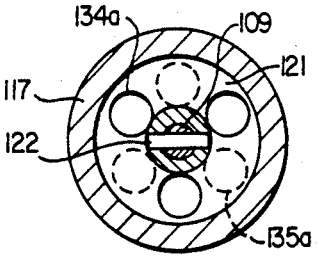
FIGS. 6A, 6B and 6C show various configurations of orifice plates used with the rotary valve embodiments of the present invention.
Figure 6B:
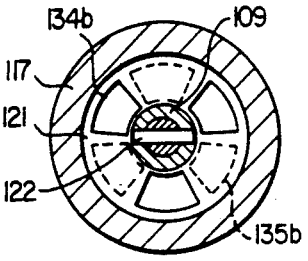
Figure 6C:
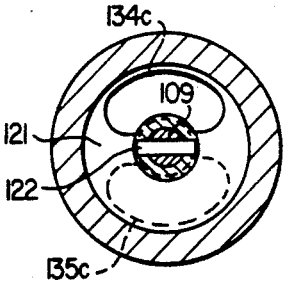

Referring now to FIG. 6A-6C there are shown a plurality of different possible configurations of the rotary valve plate 121 and the stationary valve plate 123 of the rotary valve assembly shown in FIG. 5. Referring first to FIG. 6A, there is shown a cross-sectioned view taken about the lines 6—6 of FIG. 5 illustrating a first configuration of the flow control ports. The three ports **134*a* in the rotary valve plate 121 are shown to be circular and overlying the stationary valve plate 123 containing three circular apertures 135*a* as well. In the port configuration shown in FIG. 6A, the flow control valve is closed since the apertures 134*a* in the rotary valve plate 121 and the ports 135*a* in the stationary aperture plate 123 are totally misaligned to prevent flow therethrough. The degree of alignment between the ports 134*a* and 135*a*** in the respective rotary and stationary valve plates control the degree of flow through the effective orifice of the valve, with a variation from full open to full closed being accomplished by a rotation of 60 degrees.

Referring now to FIG. 6B, there is similarly shown a cross-sectioned view of the port sub 117 of the valve taken about the line 6—6 of FIG. 5 illustrating a slightly different configuration of valve ports. As shown in FIG. 6B, the three flow ports in the rotary valve plate 121 are generally pie-shaped and the ports **135*b* in the stationary valve plate are also pie-shaped. This port design is similar to those in the round ports of FIG. 6A except that the ports are segments of a circle. Each of the sides of the ports 134*a* and 135*b* are straight radial planes which makes the percentage opening produced by alignment of ports 134*a* and 135*b* an equal percentage of a full opening. While the formation of the pie-shaped ports is slightly more expensive than the circular ports, the added degree of indexing control enhances the functionality of the valve. As can be seen from FIG. 6B, the degree of alignment between the ports 134*b* in the rotary valve plate 121 with the ports 135*b* in the stationary valve plate 123** determines the degree of flow which would be permitted through the effective orifice of the valve, with a variation from full open to full closed being accomplished by a rotation of 60 degrees.

Referring next to FIG. 6C, there is shown a third configuration of valve ports which may be used in the rotary valve embodiments of the present invention. FIG. 6C illustrates a cross-sectional view taken along the lines 6—6 from FIG. 5. The rotary valve plate 121 has a single kidney-shaped port **134*c* formed therein and the stationary valve plate 123 has a single kidney-shaped port 135*c* formed therein. The degree of overlap between the ports 134*c* and 135*c* determines the degree of flow through the valve control ports. In the configuration of 6C, there are 180° of shaft rotation in the relative alignment of the respective rotary and stationary valve plates from full open to full closed. In addition, the ends of the circular slots 134*c* and 135*c*** forming the kidney-shaped ports, can be also squared to produce a constant percent of opening per degree of revolution.

As can be seen from the configurations of valve ports shown in FIG. 6A–6C, each of the configurations includes a wiping-type seal, similar to a floating seat type of gate valve, between the rotary valve plate 21 and the stationary valve plate 123. The various configurations determine the degree of rotation necessary to go from full open to full close of the valve and, in addition, the shape and size of the flow ports affects the size of the effective flow orifice as well as a relationship of area to flow as a function of the angle of rotation of the rotary plate with respect to the stationary valve plate.

Referring now to FIG. 7, there is shown a partially cutaway longitudinal cross-sectioned view of the linear to rotational translation means used in certain embodiments of the flow control valve. In particular, the embodiments shown in FIGS. 3C, 3D, 3E and 3F employ a mechanical spring clutch ratchet mechanism for translating longitudinal movement of a driving shaft into rotational movement of a drive shaft in order to operate the valve sealing mechanisms of those embodiments of the invention. As shown in FIG. 7, the ratchet housing 180 contains a cam sleeve 182 which surrounds a pair of clutch mechanisms, discussed above, and a helical spring 217. A longitudinally extending key slot 206 receives a pair of dowel pins 205 and 212. The opposed ends of the cam sleeve 182 include slightly angulated slots 204 and 214 which are angled in opposite directions from one another at a circumferentially directed angle from the axial and are each at a slightly different angle from one another.

A mechanism within the drive portion of the valve, such as a solenoid or pressure pulse actuator, applies axial motion to the cam sleeve 182 to move it in either the upward direction, as shown by arrow 220, or in the downward direction, as shown by arrow 221. Upward movement of the cam sleeve 182, in the direction of arrow 220, causes the sleeve to move the upper dowel pin 200 along the angulated slot 204 to rotate the underlying drive mechanisms to which the pin is attached, and therefore rotate the stem 196 through a preselected degree of circumferential angular movement. When the sleeve 182 again returns from the upward position to the central position the internal mechanisms are gripped by the spring clutches and does not return from the angular movement it experienced. Similarly, when the cam sleeve 1B2 is moved in the downward direction, the direction of arrow 221, the dowel pin 213 is caused to move along the angulated section of the slot 214 so that the stem 196 is moved in the opposite angular direction by a preselected degree of angular rotation. When the cam sleeve 182 moves upwardly again to the central position the spring clutches prevent the stem 196 from returning to its previous angular position. The mechanism of FIG. 7 translates the axial movement of various drive means into rotational movement in order to effect the changes in effective valve orifice size within the system.

Because the upper and lower angular slots 204 and 214 are angled slightly different degrees with respect to the longitudinal axis of the cam sleeves 182 a stroke of the cam sleeve 182 in the closing direction differs from the stroke in the opening direction by, for example, about 20%. Thus, when the actuator is "pulsed closed" one pulse, and then "open" one pulse, the net movement of the valve is only 20% of the indexing stroke. This gives a net resolution of about 20% of the stroke provided by the cam sleeve and spring ratchet, for finer resolution of positioning.

Figure 8:
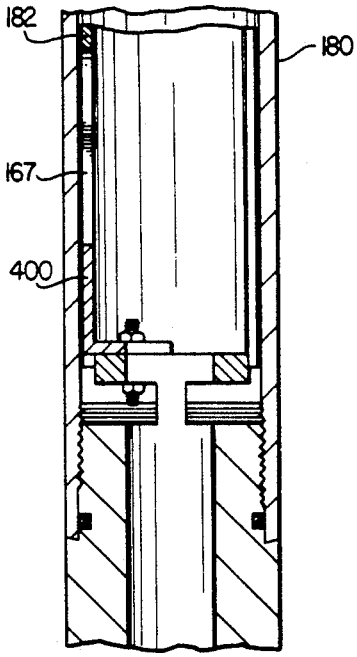
FIG. 8 is a cross-section view illustrating an alternative means of attachment of a key to the cam sleeve and its relationship to the valve housings.

Referring now to FIG. 8, there is shown a longitudinal cross-sectioned view of an alternative means of attachment of a key 400 to the cam sleeve to prevent its rotation.

Figure 9:
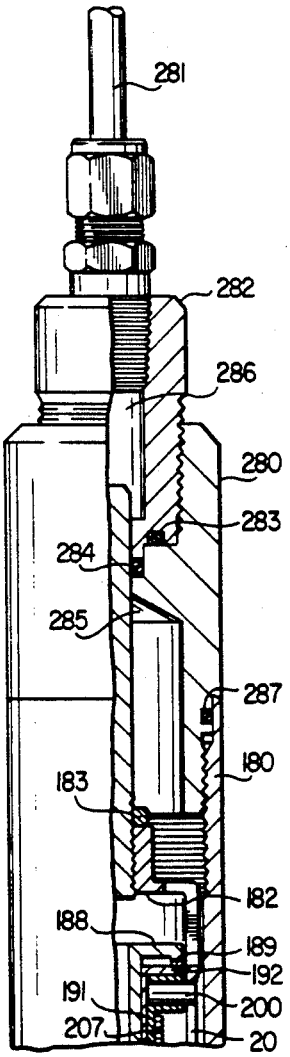
FIG. 9 is a partially cut-away and cross-sectioned view of a plunger actuation mechanism.

Referring now to FIG. 9, there is shown a partially cross-sectioned view of a pressure pulse actuator which converts changes in hydraulic pressure in a valve actuation mechanism into rotary movement within the valve. This pressure pulse actuator is similar to that used in two of the embodiments of the flow control valve of the present invention.

In FIG. 9, there is shown in the valve mechanism 280, a port bushing 281 which receives a pressure pulse control line 282 in its upper end to change the pressure within a control chamber 283. The pressure in the chamber 283 produces movement of an actuation plunger 285 the lower end Of which is affixed to a cam sleeve 182 by means of an attachment nut 183. The port bushing 281 is threadedly engaged to the upper end of the housing 310 and is sealed by means of 0-rings 283 and 284.

The axial translating movement of the piston 285 causes axial translating movement of the cam sleeve 182. A spring clutch and ratchet mechanism is fixed to the axial translating mechanism similar to that shown and described above in connection with FIG. 7 to translate the axial movement of the piston 285 into the rotational movement of a stem 96 to thereby control the rotational movement of the valve members and operate the flow control orifice of the valve.

Figure 10:
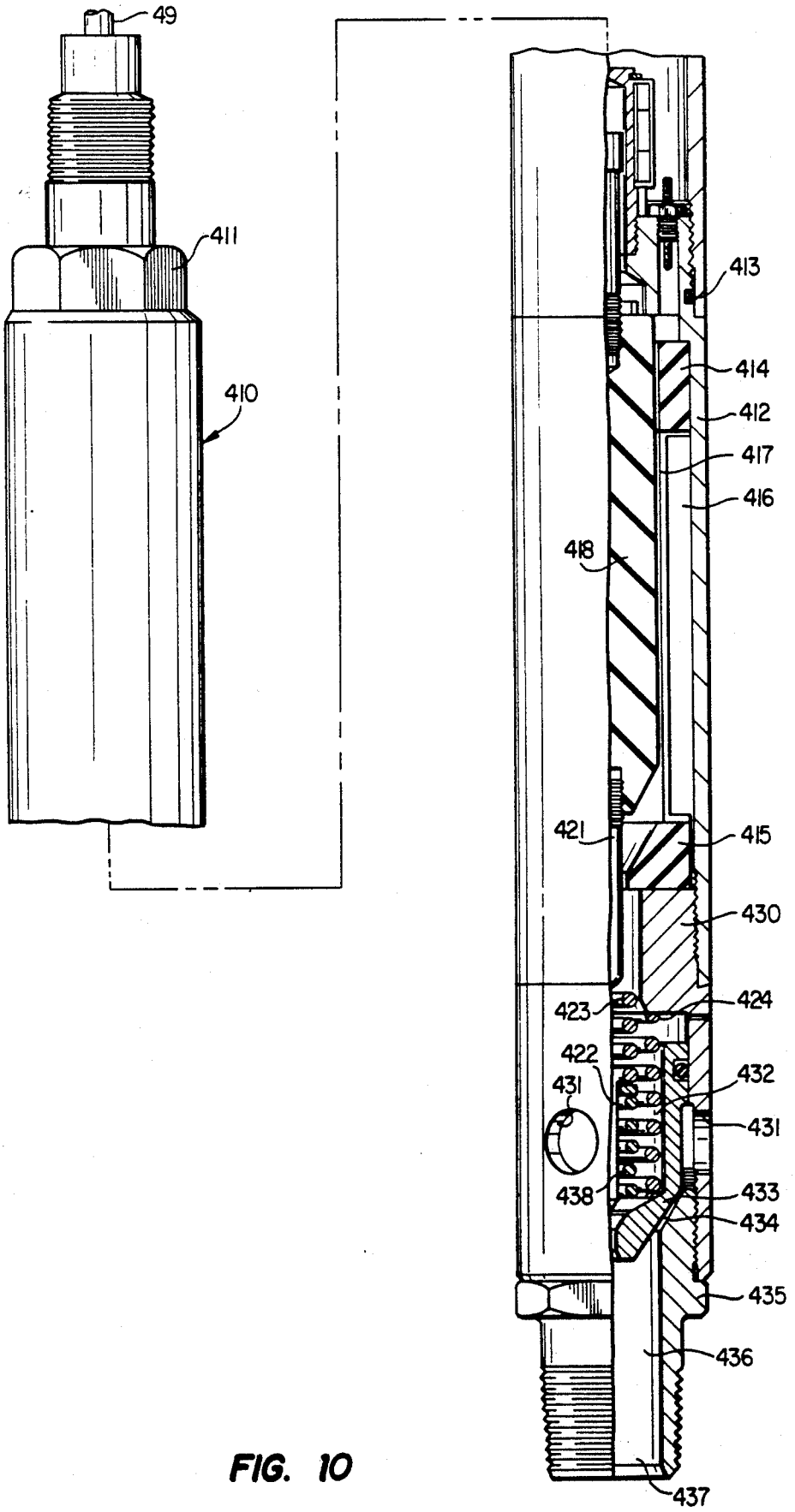
FIG. 10 is a partially out-away and cross-sectioned view of an analog solenoid version of a flow control valve used in a still further embodiment of the system of the present invention.

Referring next to FIG. 10, there is shown an additional alternate embodiment of a flow control valve system which includes an analog solenoid version Of a flow control valve. In FIG. 10, there is shown a housing 410 which includes an electrical connector sub 411 into which a control line 49 is connected. A downhole electronic package is contained within the housing 410. The upper portion of housing 410 is connected to a solenoid sub 412 by means of threaded innerengagement therebetween and is sealed by means of an 0-ring 413. An upper magnetic end piece 414 and a lower magnetic end piece 415 are separated by means of a solenoid coil 416 wound onto a coil spool 417. A solenoid core 418 is mounted for axial movement with respect to the coil 416 and in response to magnetic flux generated by current flowing through the coil 416. The lower end of the core 418 is threadedly engaged with the upper end of an actuation rod 421 the lower end of which is attached to a pilot valve plug member 422 through a resilient portion 423. The pilot valve plug member 422 is biased by means of a spring 438. The port sub 431 includes a plurality of orthogonally positioned flow intake ports 431 leading into a valve chamber 432 within which is positioned a flow control valve plug 433. The valve plug 433 is biased by spring 424 and is capable of movement in the axial direction. The plug 433 seats against a lower seal member 434 formed in the upper end of a bottom sub 435 which is threadedly attached to the lower end of the port sub 430.

As can be seen, the axial movement of the core of the solenoid 418 produces similar movement in the pilot valve plug member 422 which is followed by the control valve plug member 433 which moves between full open and sealing against the seat 434 and thereby controls the degree of flow from the flow inlet ports 431, along the flow passageway 436, and through the bottom opening 437 in the bottom sub 435. As can be seen, this enables continuous and variable control of the flow control valve by means of the quantity of current through the solenoid 416. This valve is not position stable but returns to the closed configuration when power is removed from the solenoid coil 416.

It should also be noted that while the monitor and control system used in conjunction with the flow control valve of the present invention has been illustratively shown, other more complex data acquisition systems, such as that shown in U.S. Pat. No. 4,568,933 to McCracken et al, assigned to the assignee of the present invention and hereby incorporated by reference, could be used in combination with the flow control valve of the present invention.

It is best believed that the operation and construction of the present invention will be apparent from the foregoing description. While the method and apparatus shown and described has been characterized as being preferred obvious changes and modifications may be made therein without departing from the spirit and scope of the invention as defined in the following claims.

I claim:

1. A flow control valve system, comprising:

a flow control valve including, an outer housing;

a valve chamber within said housing in flow communication with an inlet port in the wall of said housing and an outlet opening from said housing;

a variable size orifice between said valve chamber and said outlet opening to control flow therebetween;

means including a rotary shaft for changing the size of said orifice over a continuous range of sizes from fully closed to fully open;

energizable means for imparting a liner motion in both axial directions connected to means for converting said linear motion into rotational motion in both rotational directions, respectively, for driving said orifice size changing means to selectively increase or decrease the size of said orifice, said orifice changing means being position stable to maintain the size of said orifice constant when said driving means is not energized;

means remote from said valve for generating control signals for energizing said driving means; and a control line for connecting said control signal generating mean sand said driving means to permit selective changes in the orifice size of said flow control valve.

2. A flow control system in accordance with claim 1 wherein said means for converting said linear motion comprises at least two undirectional rotary motion mechanisms selectively engageable with said rotary shaft.

3. A flow control system in accordance with claim 1 wherein said means for converting said linear motion into rotational motion is operable responsive to the polarity of said control signals for energizing said driving means.

4. A flow control system in accordance with claim 1 wherein said means for converting said linear motion into rotational motion is operable responsive to the relative intensity of said control signals for energizing said driving means.

5. A flow control system in accordance with claim 1 wherein said means for converting said linear motion into rotational motion comprises cam and cam follower means.

6. A flow control system in accordance with claim 5 wherein said cam means are in a sleeve and said sleeve engages orthogonally oriented cam follower means on rotational members of said rotary motion mechanisms.

7. A flow control system in accordance with claim 2 wherein said unidirectional rotary motion mechanism includes pairs of wire clutches.

8. A flow control system in accordance with claim 7 wherein said rotary motion mechanism includes ratchet means.

9. A flow control system in accordance with claim 2 wherein said unidirectional rotary motion mechanisms include face clutches for selectively engaging said driven shaft.

10. A flow control system in accordance with claim 9 wherein said clutch means comprises toothed face clutches.

11. A flow control system in accordance with claim 10 wherein the angle of the teeth forming said toothed face clutches approximate the operating angles on said cam and cam follower mechanisms to prevent camming apart of said teeth on said toothed face clutches.

* * * * *

UNITED STATES PATENT AND TRADEMARK OFFICE

CERTIFICATE OF CORRECTION

PATENT NO. : 5,176,164

DATED : January 5, 1993

INVENTOR(S) : William G. Boyle

It is certified that error appears in the above-identified patent and that said Letters Patent is hereby corrected as shown below:

Column 36, line 64, delete --liner-- and insert --linear--.

Column 37, line 9, delete --sand-- and insert --and--.

Signed and Sealed this

Thirtieth Day of August, 1994

*Attest:*

*Attesting Officer*

BRUCE LEHMAN

*Commissioner of Patents and Trademarks*